US007123220B2

(12) United States Patent
Hanari et al.

(10) Patent No.: US 7,123,220 B2
(45) Date of Patent: Oct. 17, 2006

(54) SELF-LUMINOUS DISPLAY DEVICE

(75) Inventors: Jun Hanari, Yokohama (JP); Koji Mametsuka, Ageo (JP); Manabu Watanabe, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 252 days.

(21) Appl. No.: 10/259,478

(22) Filed: Sep. 30, 2002

(65) Prior Publication Data

US 2003/0063078 A1 Apr. 3, 2003

(30) Foreign Application Priority Data

Sep. 28, 2001 (JP) ..... 2001-304723
Sep. 29, 2001 (JP) ..... 2001-375002

(51) Int. Cl.
*G09G 3/30* (2006.01)

(52) U.S. Cl. ..... 345/77

(58) Field of Classification Search ..... 345/76, 345/77, 204, 211–214; 315/169.3; 313/463
See application file for complete search history.

(56) References Cited

U.S. PATENT DOCUMENTS 4,090,189 A * 5/1978 Fisler ..... 315/169.1
6,583,775 B1 * 6/2003 Sekiya et al. ..... 345/76
6,771,241 B1 * 8/2004 Miyazawa et al. ..... 345/87

FOREIGN PATENT DOCUMENTS

JP 2001-39666 2/2001

* cited by examiner

*Primary Examiner*—Amr A. Awad
*Assistant Examiner*—Tom Sheng
(74) *Attorney, Agent, or Firm*—Oblon, Spivak, McClelland, Maier & Neustadt, P.C.

(57) ABSTRACT

An organic EL display device includes display pixels forming a display screen, scanning lines disposed along rows of the display pixels, signal lines disposed along columns of the display pixels, and a power supply section which supplies a power-supply voltage to the display pixels. Each of the display pixels includes a luminous element, a pixel switch which receives a video signal from a corresponding one of the signal lines in response to a scanning signal from a corresponding scanning line and a driving element which is connected between the luminous element and the power supply section to supply a driving current corresponding to the video signal from the pixel switch to the luminous element. Particularly, each luminous element is connected to the power supply section via a dimmer switch portion.

30 Claims, 16 Drawing Sheets

SELF-LUMINOUS DISPLAY DEVICE

CROSS-REFERENCE TO RELATED APPLICATIONS

This application is based upon and claims the benefit of priority from the prior Japanese Patent Applications No. 2001-304723 filed Sep. 28, 2001; and No. 2001-375002, filed Sep. 29, 2001, the entire contents of both of which are incorporated herein by reference.

BACKGROUND OF THE INVENTION

1. Field of the Invention

This invention relates to a display device having a plurality of display pixels arrayed in a matrix form to display an image, to a driving method thereof and, for example, to a self-luminous display device in which each display pixel is configured by a self-luminous element such as an organic EL (Electro Luminescence) element.

2. Description of the Related Art

In recent years, much attention has been focused on organic EL display devices as monitor displays for portable information terminals since the devices have such characteristics as lightness, thinness, and high luminance. A typical organic EL display device includes organic EL elements as self-luminous elements incorporated in display pixels which are arrayed in a matrix form to display an image. In this organic EL display device, a plurality of scanning lines are disposed along rows of the display pixels, a plurality of signal lines are disposed along columns of the display pixels, and a plurality of pixel switches are disposed near intersections of the scanning and signal lines.

Each display pixel includes a pixel switch, driving element and organic EL element. The pixel switch is connected to receive a video signal from a corresponding signal lines in response to a scanning signal from a corresponding scanning line. The driving element is connected in series with the organic EL element between a pair of power lines to supply a driving current corresponding to the video signal from the pixel switch. The driving element and pixel switch are formed of thin-film transistors disposed on a glass or synthetic resin substrate, a conductive substrate, or a semiconductor substrate having an insulating film of $SiO_2$ or SiN, for example.

The organic EL element has a structure in which a luminous layer is formed of a thin film containing fluorescent organic compounds of red, green or blue, and is held between the cathode and the anode so that holes and electrons are supplied and recombined in the luminous layer to produce excitons. The organic EL element outputs light radiated upon deactivation of the excitons. The anode is a transparent electrode formed of ITO or the like and the cathode is a reflective electrode formed of a metal such as aluminum. With the this structure, the organic EL element can provide a luminance of about 100 to 100000 cd/$m^2$ with an applied voltage of just 10 V or less.

The driving current of the organic EL element is controlled by utilizing the constant current characteristic of a driving thin-film transistor serving as the driving element. FIG. 28 shows the relation between the gate-source voltage Vgs and the driving current I1 of the driving thin-film transistor. If the voltage Vgs varies, the current I1 flowing at this time is determined according to equi-Vgs lines as shown in FIG. 28. However, while the transistor is operated in a saturation region, the current I1 can be kept substantially constant even if the drain-source voltage Vds varies. In the I-V characteristic of the organic EL element shown in FIG. 28, if the voltage Vds is determined at a certain value, the intersection between the equi-Vgs line and the I-V characteristic curve becomes an operating point of the organic EL element and the current I1 flows when voltage V1 is applied to the organic EL element. The current-luminance characteristic of the organic EL element is approximately linear, and if the current is constant, the luminance is also constant. Therefore, even if the I-V characteristic varies, the current or luminance is kept constant in so far as the transistor characteristic is kept unchanged.

Further, if the preset potential from the signal line X is applied to the gate of the driving thin-film transistor as the voltage Vgs by turning ON the pixel switch, the operating point of the organic EL element which is an intersection between the I-V characteristic curve and the equi-Vgs line of FIG. 28 can be selected so that multi-gradation display can be attained.

In a normal liquid crystal display device, the brightness of the backlight is generally adjusted to optimize the power consumption and ease of observation of an image depending on the service environment. For example, when the user carries around a portable information terminal which is battery-driven, electricity of the battery is saved by causing the user to select a low-power consumption operation in which the backlight is made dark or automatically changing the operation mode into the above operation when it is battery-driven. The brightness of the backlight can be made dark by lowering the power-supply voltage applied from the exterior.

On the other hand, the organic EL element is a self-luminous element whose luminance depends on a driving current thereof. Therefore, the luminance of the organic EL element cannot be adjusted by changing the power-supply voltage.

In a gradation display system in which a driving thin-film transistor turned ON/OFF in the non-saturation region is used, it is considered to adjust the ON-time of the thin-film transistor in order to attain desired luminance and gradation. However, extremely slight time adjustment is required and, as a result, it becomes difficult to adequately set either the luminance or gradation.

Further, it has been considered to change the video signal level in order to attain desired luminance which is half the maximum luminance, for example. However, if the currents flowing through all of the organic EL elements in the luminance adjusting system are equally reduced, the white balance cannot be maintained due to a difference in the luminance characteristics of the organic EL elements which depend on the luminescent colors of red, green and blue. If a correction circuit which corrects variation amounts of video signal levels for respective luminescent colors is used in order to solve the above problem, it cannot be avoided that the circuit configuration is complicated in comparison with that of the brightness adjusting system of the liquid crystal display device.

BRIEF SUMMARY OF THE INVENTION

An object of the present invention is to provide, as a solution to the above problem, a self-luminous display device which can adjust the luminance irrespective of gradation control.

According to the present invention, there is provided a self-luminous display device comprising a plurality of display pixels forming a display screen, a plurality of scanning lines disposed along rows of the display pixels, a plurality of signal lines disposed along columns of the display pixels, and a power-supply section which supplies a power-supply voltage to the display pixels, each of the display pixels including a luminous element, a pixel switch which receives a video signal from a corresponding signal lines in response to a scanning signal from a corresponding scanning line and a driving element which is connected between the luminous element and the power supply section to supply a driving current corresponding to the video signal from the pixel switch to the luminous element, and each luminous element being connected to the power supply section via a dimmer switch portion.

In the display device, the luminous element is connected to the power supply section via the dimmer switch portion which is independent of the driving element. Therefore, if the dimmer switch portion is turned ON at the rate of half a preset period, for example, the luminance of the luminous element can be equivalently reduced by half. That is, the luminance of the luminous element (or the luminance level for maximum gradation) can be set to a desired level irrespective of gradation control by adjusting the light emission rate of the luminous element for each unit time based on the ON time of the dimmer switch portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

There will now be described an organic EL display device according to a first embodiment of the present invention with reference to the accompanying drawings.

Figure 1:
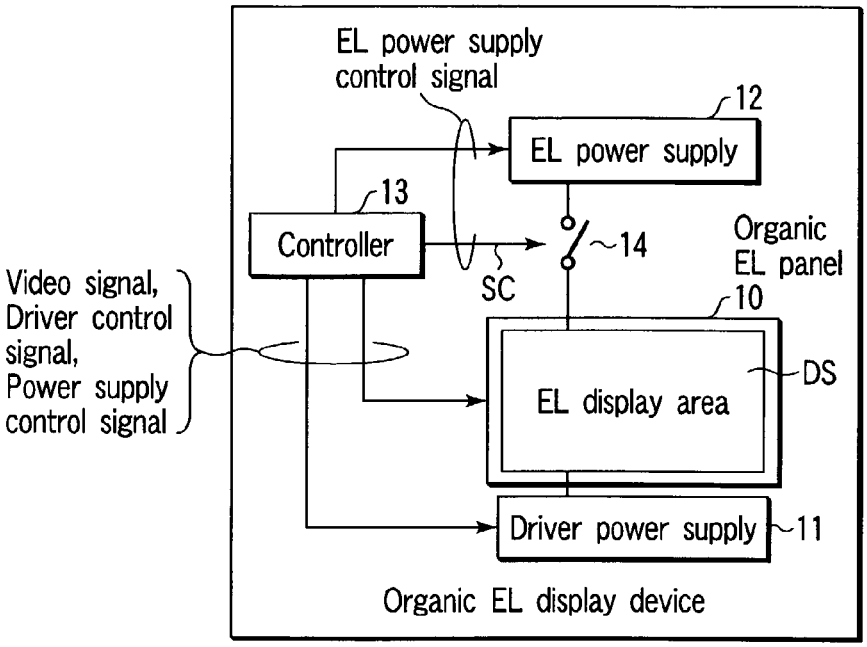
FIG. 1 is a diagram showing the whole circuit configuration of an organic EL display device according to a first embodiment of the present invention.
Figure 2:
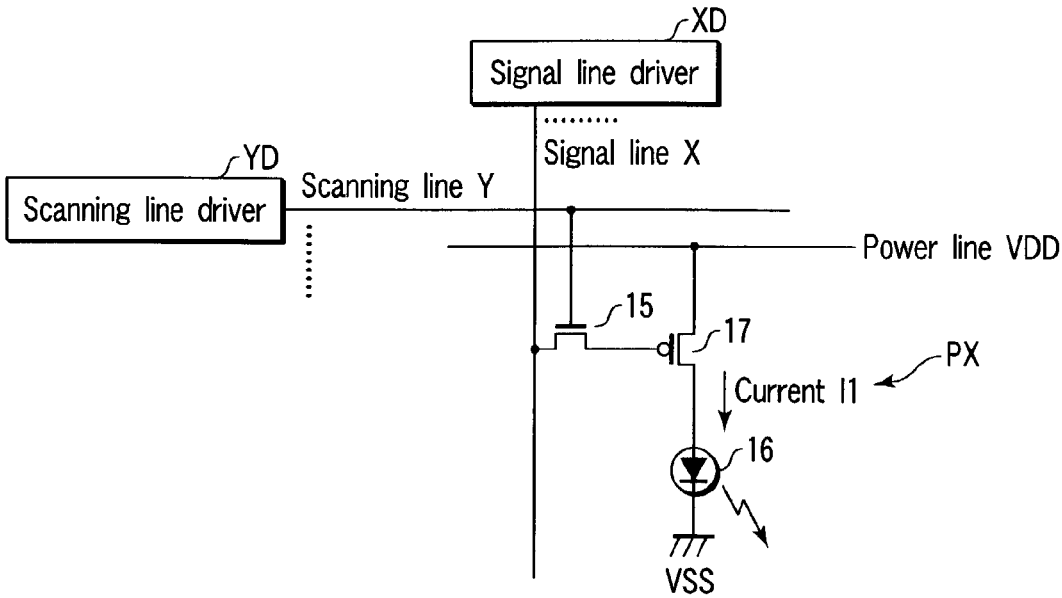
FIG. 2 is a diagram showing the circuit configuration of a display pixel of the organic EL display device shown in FIG. 1.

FIG. 1 shows the whole circuit configuration of the organic EL display device and FIG. 2 shows the circuit configuration of a display pixel PX of the organic EL display device. The organic EL display device includes an organic EL panel 10 which displays an image, a driver power supply 11 which produces a driver power-supply voltage for the organic EL panel 10, an EL power supply 12 which produces an EL power-supply voltage for the organic EL panel 10, and a controller 13 which performs the control operation to operate the organic EL panel 10 in a normal mode and in a still image display mode. The organic EL panel 10 includes a plurality of display pixels PX forming an EL display area DS which serves as a display screen, a plurality of scanning lines Y disposed along respective rows of the display pixels PX, a plurality of signal lines X disposed along respective columns of the display pixels PX, a scanning line driver YD disposed outside the display area DS to drive the scanning lines Y, and a signal line driver XD disposed outside the display area DS to drive the signal lines X. Each of the display pixels PX includes a pixel switch 15, organic EL element 16 and driving element 17. The pixel switch 15 is disposed near one of the intersections between the scanning lines Y and the signal lines X and connected to receive a video signal from one of the signal lines X in response to a scanning signal from one of the scanning lines Y. The driving element 17 is connected in series with the organic EL element 16 between a driving power line VDD and a reference power line VSS to supply a driving current corresponding to the video signal from the pixel switch 15 to the organic EL element 16. The organic EL element 16 has one of three luminescent colors of red (R), green (G) and blue (B). The luminescent colors are sequentially assigned to the organic EL elements 16 of plural columns in a preset order. For example, the pixel switch 15 is an N-channel thin-film transistor and the driving element 17 is a P-channel thin-film transistor. The scanning line driver YD and signal line driver XD include N-channel and P-channel thin-film transistors which are formed in the same process as the pixel switches 15 and driving elements 17 and integrally formed on the same insulating substrate.

The scanning line driver YD sequentially supplies a scanning signal to the scanning lines in one frame period (1F) under control of the controller 13. That is, each scanning line Y is driven by the scanning signal in a different one of horizontal scanning periods. The signal line driver XD sequentially converts a digital video signal into gradation voltages in each horizontal scanning period under control of the controller 13 and outputs the gradation voltages to the signal lines X as analog video signals.

The pixel switches 15 on each row are turned ON by a scanning signal supplied from a corresponding one of the scanning lines Y for one horizontal scanning period and are then kept turned OFF until the scanning signal is supplied again after one frame period. The driving elements 17 respectively supply those driving currents to the organic EL elements 16, which correspond to the analog video signals supplied via the respective pixel switches 15 and held by wiring capacitances.

The scanning line driver YD and signal line driver XD are connected to the driver power supply 11 so as to receive the driver power-supply voltage, and the display pixels PX are connected to the EL power supply 12 via the power lines VDD and VSS so as to receive the EL power-supply voltage.

The organic EL display device further includes a dimmer switch 14 which is inserted into the driving power line VDD between the EL power supply 12 and the display pixels PX. The dimmer switch 14 is controlled to be turned ON and OFF by a luminance adjusting switch control signal SC from the controller 13 in a preset cycle or at pseudo random. In this case, "pseudo random" indicates a state in which the ON time is equivalently set to a preset rate of a constant time period. The organic EL element 16 emits light when the dimmer switch 14 is turned ON. In the case where the organic EL element 16 is observed for a preset period of time and the total ON time period of the dimmer switch 14 is half the preset period of time, the luminance of the organic EL element 16 becomes equivalent to half the maximum level obtained when the dimmer switch 14 is kept ON for the preset period of time.

In the organic EL display device of the present embodiment, the organic EL element 16 is connected to the EL power supply 12 via the dimmer switch 14 which is independent of the driving element 17. Therefore, if the dimmer switch 14 is kept ON for half a preset period in each preset period, for example, the luminance of the organic EL element 16 can be equivalently reduced by half. That is, the luminance of the organic EL element 16 can be set to a desired level irrespective of gradation control, by adjusting the light emission rate for each unit time based on the ON time of the dimmer switch 14.

In the present embodiment, the dimmer switch 14 is disposed outside the organic EL panel 10, but it can be formed on a glass plate used as a circuit board of the organic EL panel 10. However, if a large amount of current flows in the dimmer switch 14, it is preferable that a plurality of thin-film transistors are formed as the dimmer switch 14 so as to prevent the current from being concentrated in one portion.

Figure 3:
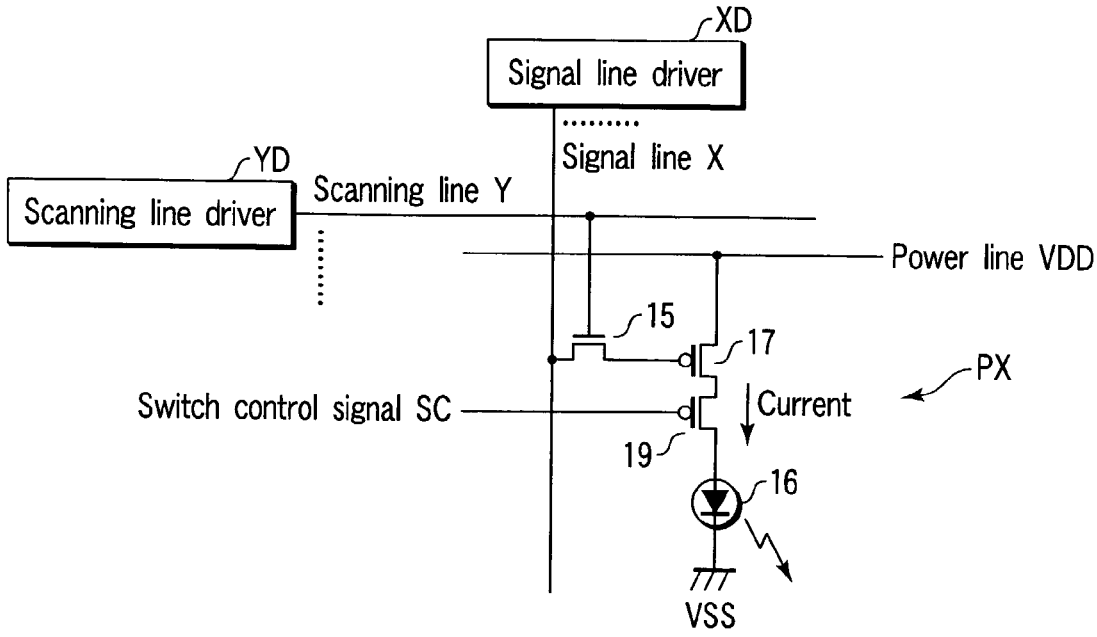
FIG. 3 is a diagram showing the circuit configuration of a display pixel of an organic EL display device according to a second embodiment of the present invention.
Figure 4:
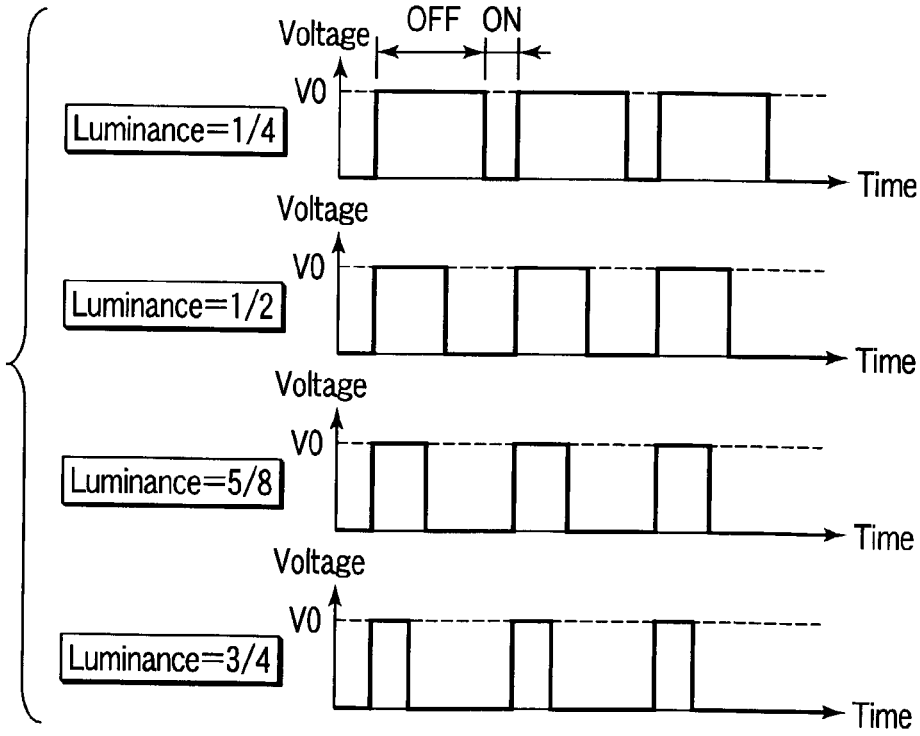
FIG. 4 is a timing chart showing the relation between the ON/OFF state of a dimmer switch of the display pixel shown in FIG. 3 and the luminance of an organic EL element.

Next, an organic EL display device according to a second embodiment of the present invention is explained. FIG. 3 shows the circuit configuration of a display pixel PX of the organic EL display device. The organic EL display device is similar to the organic EL display device shown in FIG. 1. Therefore, in FIG. 3, portions similar to those of the organic EL display device shown in FIG. 1 are denoted by the same reference symbols. The dimmer switch 14 shown in FIG. 1 is omitted in the present embodiment, but the whole configuration except the above point is the same as the configuration shown in FIG. 1. In the organic EL display device, each display pixel PX has a dimmer switch 19 which is used instead of the dimmer switch 14, as shown in FIG. 3. The dimmer switch 19 is connected in series between an organic EL element 16 and a driving element 17 and controlled by a switch control signal SC from a controller 13. For example, the dimmer switch 19 is formed of a P-channel thin-film transistor like the driving element 17. In this case, when the switch control signal SC is set at a low level, the dimmer switch 19 is turned ON to cause the organic EL element 16 to emit light. For example, if the ON time is changed to periods which are respectively ¼, ½, ⅝, ¾ times the preset period as shown in FIG. 4, the luminance of the organic EL element 16 is also set to ¼, ½, ⅝, ¾ times the maximum level according to the above change.

Also, in the present embodiment, the luminance of the organic EL element can be set to a desired level irrespective of gradation control by adjusting the light emission rate for each unit time based on the ON time of the dimmer switch 19, as in the first embodiment.

Figure 5:
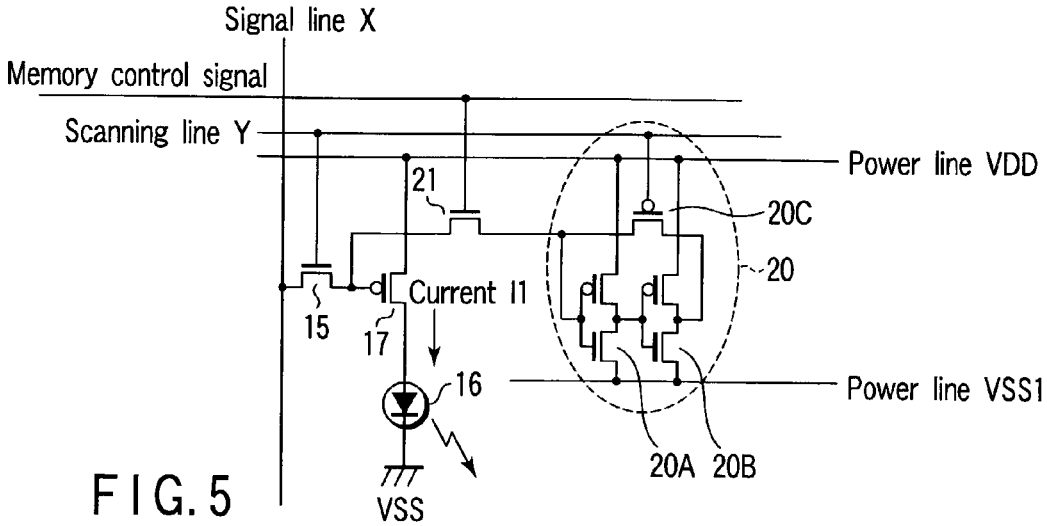
FIG. 5 is a diagram showing the circuit configuration of a modification of the display pixel shown in FIG. 2.
Figure 6:
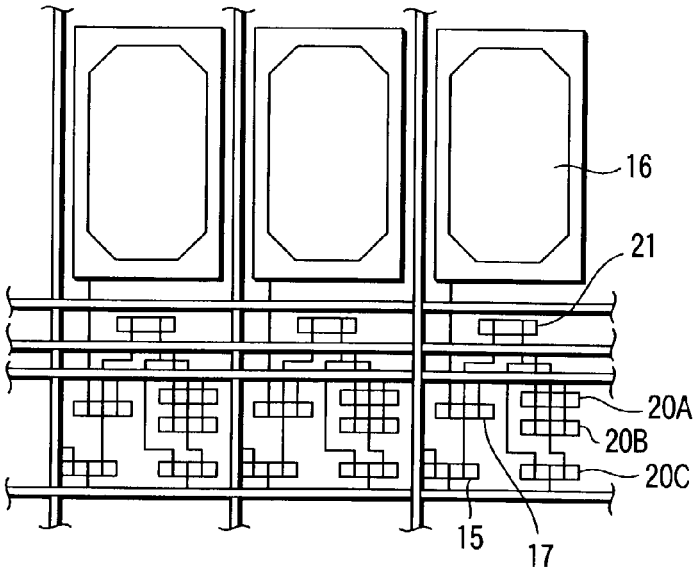
FIG. 6 is a view schematically showing the plane structure of the display pixel shown in FIG. 5.

FIG. 5 shows the circuit configuration of a modification of the display pixel PX shown in FIG. 2 and FIG. 6 schematically shows the plane structure of the display pixel PX shown in FIG. 5. In the modification, the display pixel PX includes a static memory section 20 and a memory control switch 21 as shown in FIG. 5. The memory control switch 21 is connected between the gate of the driving element 17 and the static memory section 20 and is controlled by a memory control signal from the controller 13. For example, the memory control switch 21 is formed of an N-channel thin-film transistor like the pixel switch 15. The static memory section 20 includes a first inverter 20A, second inverter 20B and switch element 20C. Each of the inverters 20A and 20B is formed of P-channel and N-channel thin-film transistors which are connected in series between the power lines VDD and VSS1 and the switch element 20C is formed of a P-channel thin-film transistor which is driven via the scanning line Y. The inverter 20A receives a video signal from the gate of the driving element 17 via the memory control switch 21 and inverts the same, the inverter 20B inverts the video signal output from the inverter 20A, and the switch element 20C outputs the video signal output from the inverter 20B to the inverter 20A and outputs the same to the gate of the driving element 17 via the memory control switch 21.

The video signal is supplied to the gate of the driving element 17 from the signal line X via the pixel switch 15 when the scanning line Y is set at the high level. The memory control switch 21 supplies the video signal to the static memory section 20 under control of the memory control signal. The switch element 20C is set in the OFF state when the scanning line Y is set at the high level and it is set into the ON state if the scanning line Y is set at the low level. As a result, the video signal is held in the static memory section 20 in a digital form of a high or low potential.

Luminance adjustment made by use of the dimmer switch 14 shown in FIG. 1 is also applicable to the case where each display pixel PX has the above-described static memory section 20. Further, since a still image can be displayed by use of the static memory section 20, the power consumption can be further lowered by suspending the operations of the signal line driver XD and scanning line driver YD. The static memory section 20 is connected to the power line VDD which is commonly used by the dimmer switch 14, and therefore, the power line VSS1 is independently provided from the power line VSS so as not to make the memory operation unstable.

Figure 7:
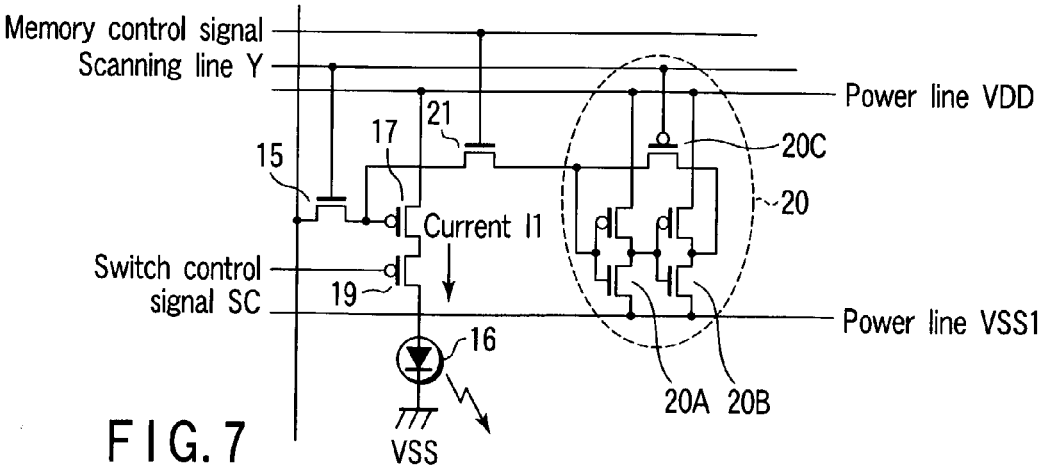
FIG. 7 is a diagram showing the circuit configuration of a modification of the display pixel shown in FIG. 3.

FIG. 7 shows the circuit configuration of a modification of the display pixel PX shown in FIG. 3. In this modification, each display pixel PX has a dimmer switch 19 in addition to the static memory section 20 shown in FIG. 5. In this case, not only luminance adjustment of the display pixel PX can be made by use of the dimmer switch 19, but also an unstable operation of the static memory section 20 caused by the dimmer switch 14 shown in FIG. 1 can be eliminated without fail. Further, since a still image can be displayed by use of the static memory section 20, as in the modification shown in FIG. 5, the power consumption can be further lowered by suspending the operations of the signal line driver XD and scanning line driver YD.

The static memory sections 20 shown in FIGS. 5 and 7 are each configured by a one-bit digital memory to display an image in two luminance levels, but if it is configured to have a plural-bit configuration, intermediate levels between the two luminance levels are available.

Figure 8:
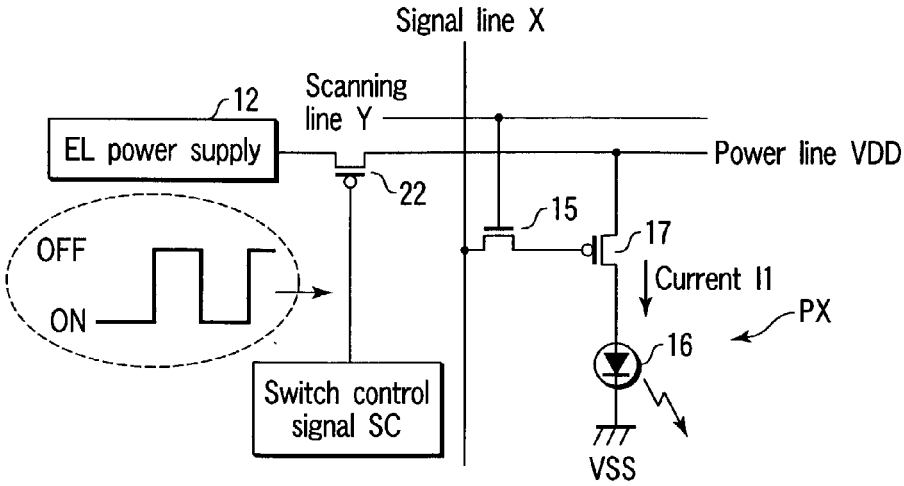
FIG. 8 is a diagram schematically showing a luminance adjusting system of a display pixel of an organic EL display device according to a third embodiment of the present invention.
Figure 9:
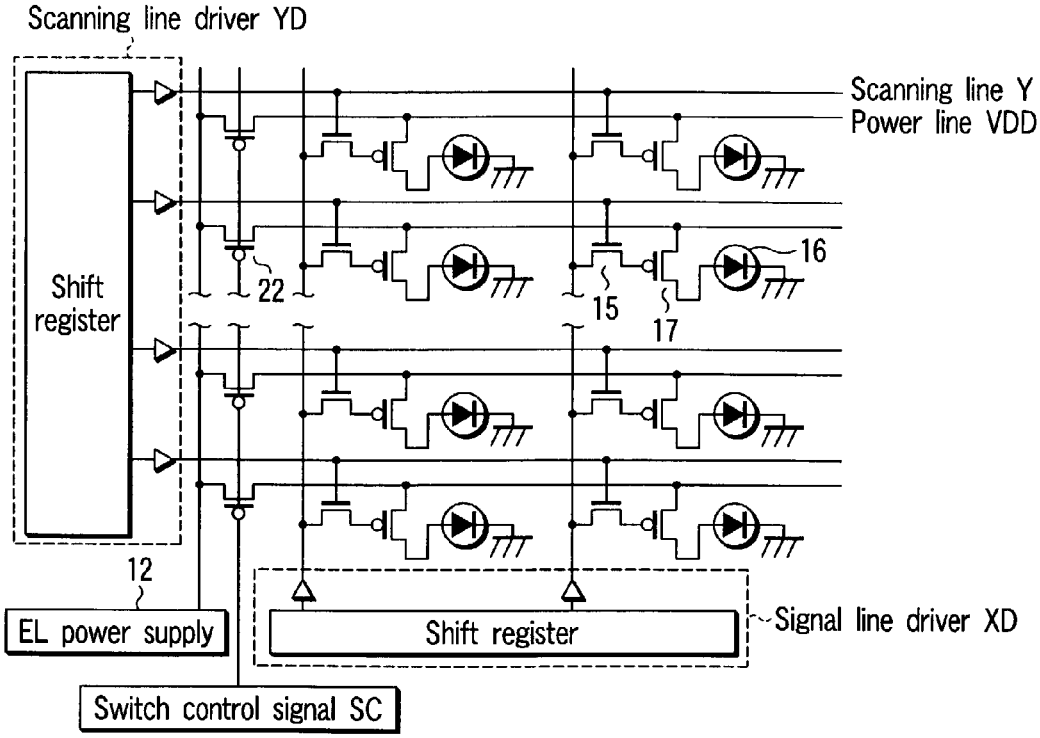
FIG. 9 is a diagram showing the whole circuit configuration of an organic EL panel using dimmer switches which are the same as a dimmer switch shown in FIG. 8.

Next, an organic EL display device according to a third embodiment of the present invention is explained. FIG. 8 schematically shows a luminance adjusting system of a display pixel PX of the organic EL display device, and FIG. 9 shows the circuit configuration of the organic EL panel 10. The organic EL display device is similar to the organic EL display device shown in FIG. 1. Therefore, in FIGS. 8 and 9, portions which are similar to those of the organic EL display device shown in FIG. 1 are denoted by the same reference symbols. The dimmer switch 14 shown in FIG. 1 is omitted in the present embodiment and the remaining configuration is the same as that shown in FIG. 1. In the organic EL display device, a plurality of dimmer switches 22 are provided instead of the dimmer switch 14. As shown in FIG. 8, each dimmer switch 22 is a P-channel thin-film transistor inserted into a power line VDD formed along the display pixels PX of one row on a glass plate which is used as a circuit board of the organic EL panel 10.

In the whole portion of the organic EL panel 10, the dimmer switches 22 are arranged in one column as shown in FIG. 9 and assigned to the respective rows of the display pixels PX. The dimmer switches 22 are controlled to be turned ON and OFF by a luminance adjusting switch control signal SC from a controller 13 in a preset cycle or at pseudo random. Each dimmer switch 22 equally switches driving currents flowing in organic EL elements 16 of the display pixels PX of one row connected to a corresponding one of the power lines VDD. The luminance of the organic EL element 16 becomes equivalent to half the maximum level which is obtained when the dimmer switch 22 is kept ON for a preset period of time in a case where the total ON time period of the dimmer switch 22 is half the preset period of time, for example.

In the organic EL display device of the present embodiment, the organic EL elements 16 are connected to an EL power supply 12 via the respective dimmer switches 22 which are provided independently of the driving elements 17. Therefore, if the dimmer switch 22 is kept in the ON state for a half preset period, in each preset period, for example, the luminance of the organic EL element 16 can be equivalently reduced by half. That is, the luminance of the organic EL element 16 can be set to a desired level irrespective of gradation control, by adjusting the light emission rate for each unit time based on the ON time of the dimmer switch 22.

Figure 10:
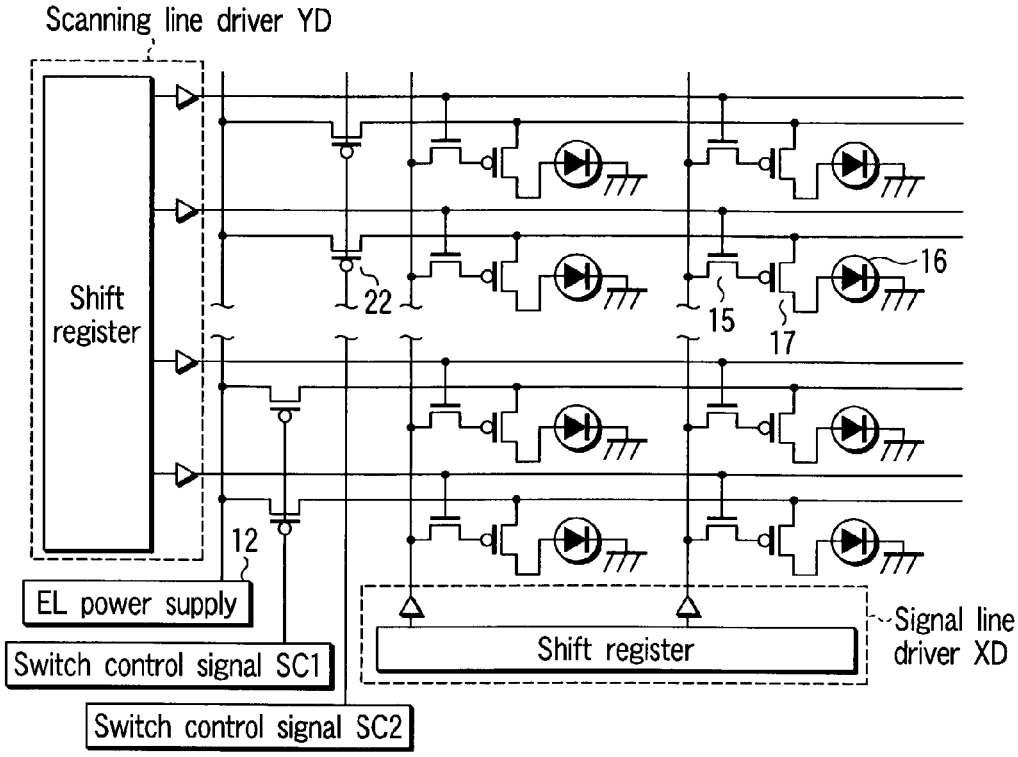
FIG. 10 is a diagram showing the circuit configuration of an organic EL panel of an organic EL display device according to a fourth embodiment of the present invention.
Figure 11:
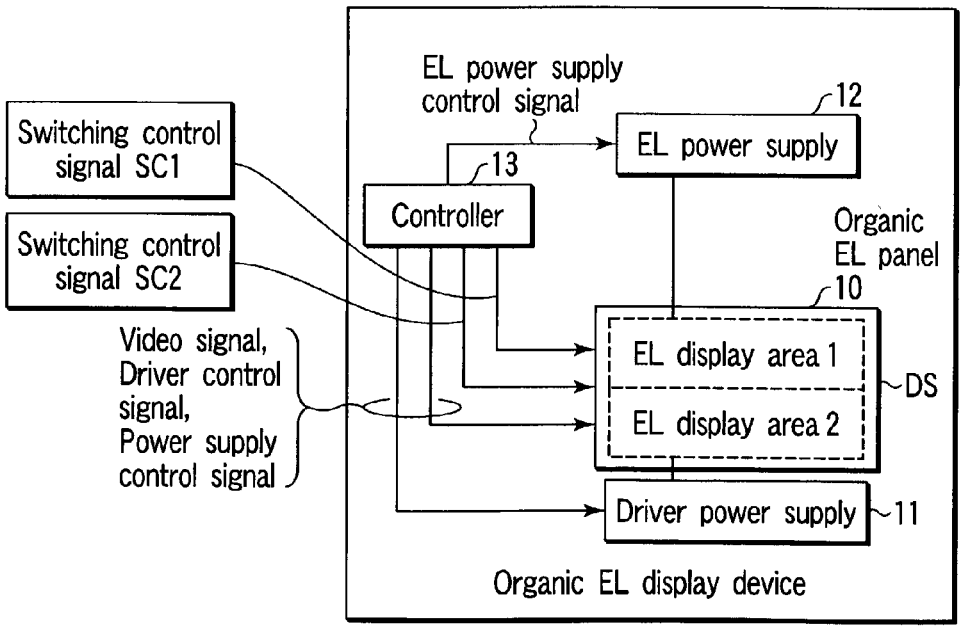
FIG. 11 is a diagram showing the whole circuit configuration of the organic EL display device having dimmer switches of two blocks shown in FIG. 10.

Next, an organic EL display device according to a fourth embodiment of the present invention is explained. FIG. 10 shows the circuit configuration of an organic EL panel 10 of the organic EL display device and FIG. 11 shows the whole circuit configuration of the organic EL display device. The organic EL display device is similar to the organic EL display device shown in FIG. 9. Therefore, in FIGS. 10 and 11, portions which are similar to those of the organic EL display device shown in FIG. 9 are denoted by the same reference symbols. In the organic EL display device, as shown in FIG. 11, a plurality of display pixels PX are divided into two blocks forming EL display areas 1 and 2 in the upper and lower portions of the display screen DS. Further, as shown in FIG. 10, a plurality of dimmer switches 22 are divided into two blocks in correspondence to the EL display areas 1 and 2, and the two divided blocks of the dimmer switches are respectively controlled by switch control signals SC1 and SC2 supplied from a controller 13. The switch control signals SC1 and SC2 are substantially equivalent to the switch control signal SC used in the third embodiment. The display screen is not necessarily divided into plural blocks of the same size. Further, the blocks can be not only divided in the column direction of the display pixels PX, but also divided in the row direction. In this case, the power line VDD is also divided according to the divided blocks. The EL power supply 12 supplies an EL power-supply voltage to the dimmer switches 22 inserted into the power lines VDD divided in correspondence to the divided blocks. Since it is required that the dimmer switches 22 have a current-supply capacity adapted to the block size, the channel size of the thin-film transistor is determined according to the required current-supply capacity when a thin-film transistor is formed as the dimmer switch 22.

The dimmer switch 22 is controlled to be turned ON and OFF in a preset cycle or at pseudo random under control of the switch control signals SC1 and SC2 from the controller 13. Each dimmer switch 22 equally switches driving currents flowing in organic EL elements 16 of the display pixels PX of one block connected to a corresponding one of the power lines VDD. The luminance of the organic EL element 16 becomes equivalent to half the maximum level which is obtained when the dimmer switch 22 is kept ON for a preset period of time in a case where the total ON time period of the dimmer switch 22 is half the preset period of time, for example.

In the organic EL display device of the present embodiment, the organic EL elements 16 are connected to the EL power supply 12 via the respective dimmer switches 22 which are commonly used for each block. Therefore, if the dimmer switch 22 is kept in the ON state for half a preset period, in each preset period, for example, the luminance of the organic EL element 16 can be equivalently reduced by half. That is, the luminance of the organic EL element 16 can be set to desired luminance irrespective of gradation control by adjusting the light emission rate for each unit time based on the ON time of the dimmer switch 22. Further, since the luminance of the EL display areas 1 and 2 can be set to different luminance levels, the range of application thereof can be expanded.

In each of the above embodiments, the switch control signal SC, SC1 or SC2 is generated from the controller 13 and supplied to the dimmer switch 14, 19 or 22, but the switch control signal can be supplied from a host processing unit or the like disposed outside the organic EL display device to the dimmer switch 14, 19 or 22. Further, the controller 13 can be designed to generate a switch control signal SC which lowers the luminance of the organic EL element 16 in a dark place by referring to an output signal of a sensor which is provided to sense outside light. In addition, the controller 13 can be designed to refer to an output signal of a sensor which detects the remaining battery power, and generate a switch control signal SC for lowering the luminance of the organic EL element 16 when the remaining battery power is reduced to a predetermined amount.

Figure 12:
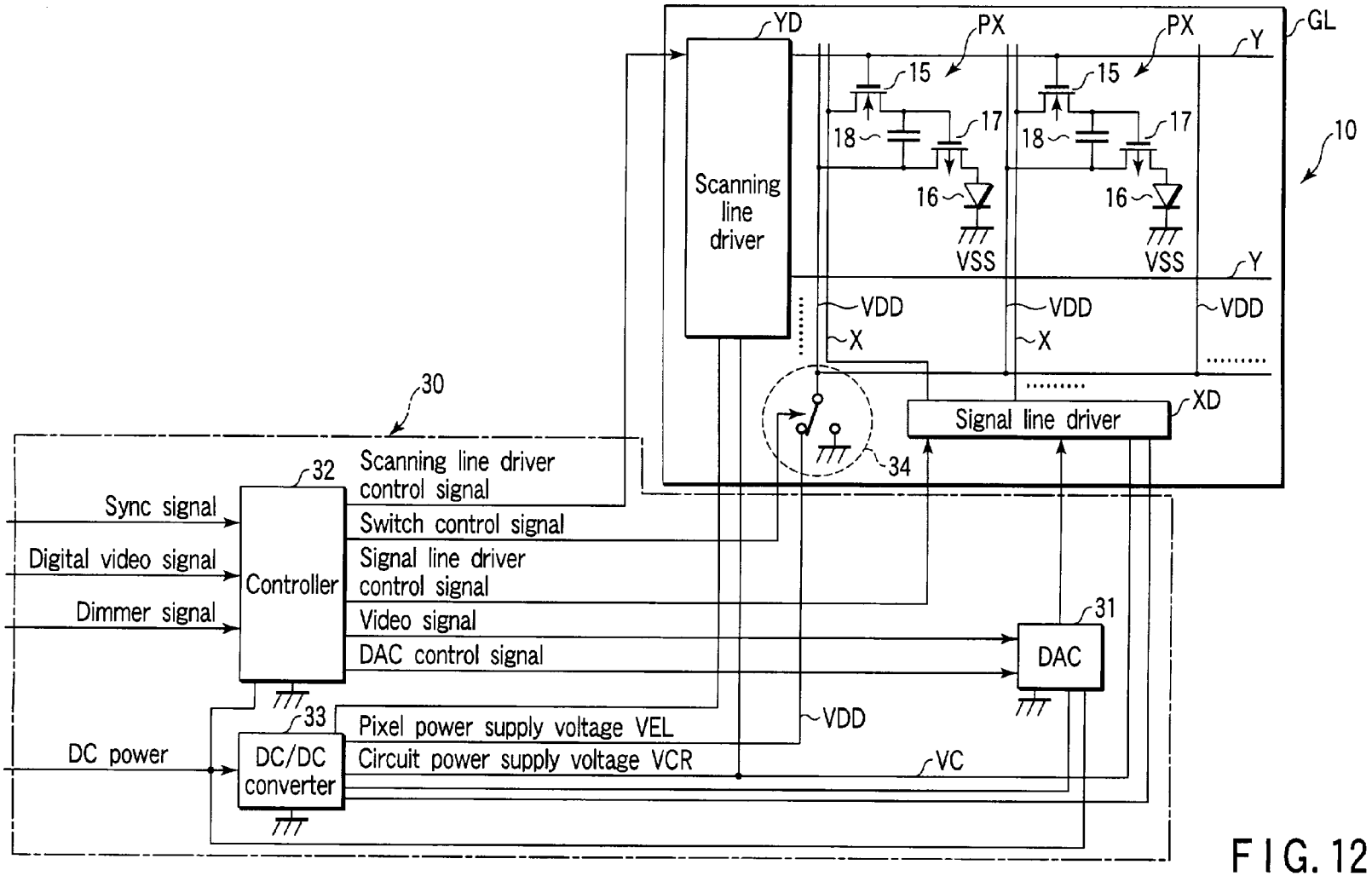
FIG. 12 is a circuit diagram showing the configuration of an organic EL display device according to a fifth embodiment of the present invention.

Next, an organic EL display device according to a fifth embodiment of the present invention is explained with reference to the accompanying drawings. FIG. 12 shows the configuration of the organic EL display device. The organic EL display device includes an organic EL panel 10 and an external drive circuit 30 which drives the organic EL panel 10.

The organic EL panel 10 includes a plurality of display pixels PX arrayed in a matrix form on an insulating substrate GL such as a glass plate to display an image, a plurality of scanning lines Y disposed along respective rows of the display pixels PX, a plurality of signal lines X disposed along respective columns of the display pixels PX, a plurality of pixel switches 15 disposed near the intersections between the scanning lines Y and the signal lines X, a scanning line driver YD which drives the scanning lines Y, and a signal line driver XD which drives the signal lines X. Each of the display pixels PX includes an organic EL element 16, a driving transistor 17 connected in series with the organic EL element 16 between paired power lines VDD and VSS and a capacitor 18 which holds the gate voltage of the driving transistor 17. The pixel switch 15 is formed of an N-channel thin-film transistor having a semiconductor layer of polycrystalline silicon, for example. The pixel switch permits the capacitor 18 to hold the voltage of a video signal supplied from a corresponding one of the signal lines X when it is driven by a scanning signal from a corresponding scanning line Y and supplies the thus held voltage to the driving transistor 17 as the gate voltage. The driving transistor 17 is formed of a P-channel thin-film transistor having a semiconductor layer of polycrystalline silicon, for example, and causes a driving current corresponding to the gate voltage to flow in the organic EL element 16. The organic EL element 16 has a structure in which a luminous layer is formed of a thin film containing fluorescent organic compounds of red, green or blue, and is held between the cathode and the anode so that holes and electrons are supplied and recombined in the luminous layer to produce excitons. The organic EL element 16 outputs light radiated upon deactivation of the excitons. In the organic EL panel 10, columns of organic EL elements 16 whose luminescent color is red, columns of organic EL elements 16 whose luminescent color is green and columns of organic EL elements 16 whose luminescent color is blue are repeatedly arranged in order of red, green and blue in the row direction.

The external drive circuit 30 is formed on an external drive circuit board disposed outside the organic EL panel 10. The external drive circuit 30 comprises a DA converter circuit (DAC) 31 which has DA converters for converting a digital signal into analog signals, and supplies analog video signals for the signal lines to the signal line driver XD based on the analog signals. It further comprises a controller 32 which controls the scanning line driver YD, signal line driver XD and DAC 31, and a DC/DC converter 33 which produces power-supply voltages such as a pixel power-supply voltage VEL and a circuit power-supply voltage VCR, based on a DC power-supply voltage supplied from the exterior and outputs the power-supply voltages to drive the organic EL panel 10. Among the above power-supply voltages, the pixel power-supply voltage VEL is applied between the paired power lines VDD and VSS to operate the display pixels PX. The controller 32 receives a digital video signal and sync signal which are supplied from the exterior, and produces a vertical scanning control signal for controlling the vertical scanning timing, a horizontal scanning control signal for controlling the horizontal scanning timing, and a DAC control signal synchronized with the horizontal and vertical scanning timings, based on the sync signal. Further, the controller 32 respectively supplies the vertical scanning control signal, horizontal scanning control signal and DAC control signal to the scanning line driver YD, signal line driver XD and DAC 31, and also supplies a digital video signal to the DAC 31 in synchronism with the horizontal and vertical scanning timings.

The DAC 31 is a converter IC disposed on the external drive circuit board and sequentially converts the digital video signal into an analog form under control of the DAC control signal. The signal line driver XD samples the analog video signals derived from the DAC 31 in each horizontal scanning period under control of the horizontal scanning control signal to supply the sampled signals to the signal lines X in parallel. Further, the scanning line driver YD sequentially supplies a scanning signal to the scanning lines Y in each vertical scanning period under control of the vertical scanning control signal. The pixel switches 15 on each row are turned ON for one horizontal scanning period by a scanning signal commonly supplied thereto from a corresponding one of the scanning lines Y and are then kept in the OFF state until the scanning signal is supplied again after one vertical scanning period. The driving transistors 17 of one row cause driving currents corresponding to voltages of video signals supplied as gate voltages from the signal lines X by turn-ON of the pixel switches 15 to flow into the organic EL elements 16.

Further, the organic EL display device includes a dimmer switch portion 34 which is formed on the insulating substrate GL of the organic EL panel 10 and controlled by a switch control signal SC from the controller 32. The dimmer switch portion 34 is inserted between a node of the DC/DC converter 33 side and a node of the display pixel PX side serving as the power line VDD on the insulating substrate GL. It is set into a first state in which the display pixel PX side node is connected to the DC/DC converter 33 side node to cause all of the organic EL elements 16 to emit light when the switch control signal SC is set at the high level and set into a second state in which the display pixel PX side node is connected to the power line VSS to interrupt light emission of all of the organic EL elements 16 when the switch control signal SC is set at the low level. The controller 32 determines the luminance level based on a dimmer signal supplied from the exterior and changes the ratio of the high-level period to the low-level period of the switch control signal SC according to the luminance level in each vertical scanning period. The dimmer switch portion 34 equally switches currents which respectively flow in all of the organic EL elements 16 under control of the switch control signal SC to equally control the ratios of the luminous time to the non-luminous time of each of the organic EL elements 16. In this case, the dimmer signal is a signal obtained as the result that desired luminance is selected by use of a luminance selection switch or the like which is operated by a user or an external computer.

Figure 13:
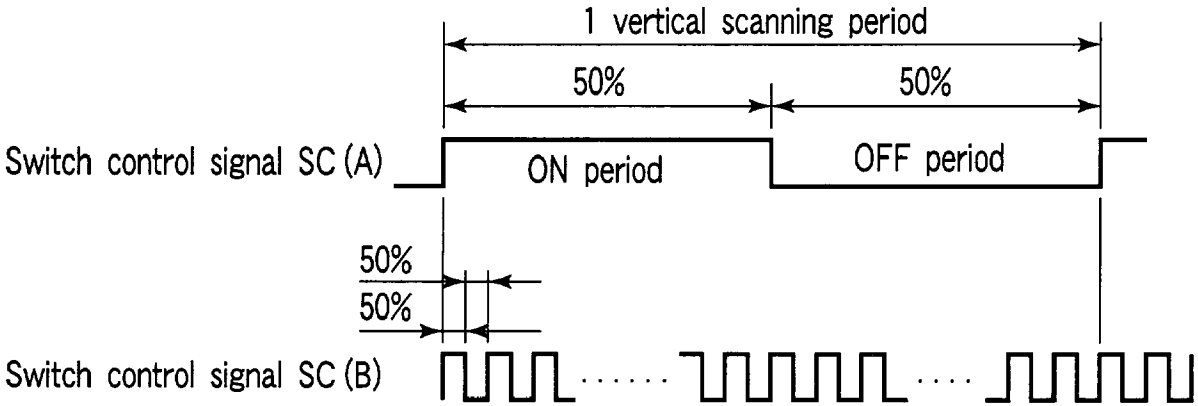
FIG. 13 is a timing chart showing two types of switch control signals used to set the ratio of the ON period to the OFF period of a dimmer switch portion shown in FIGS. 12 to 50%:50%.

In the luminance adjusting operation of setting the luminance of the screen to 50%, a switch control signal SC(A) as shown in FIG. 13 is supplied to the dimmer switch portion 34. In the case of the switch control signal SC(A), the front half portion of one vertical scanning period is set as an ON period for supply of a driving current and the latter half portion thereof is set as an OFF period for interruption of the driving current. The dimmer switch portion 34 performs a switching operation only once in one vertical scanning period under control of the switch control signal SC(A). As a result, the ratio of the luminous time to the non-luminous time of all the organic EL elements 16 is set to 1:1 so as to set the luminance of the screen to 50% of the maximum luminance.

Figure 14:
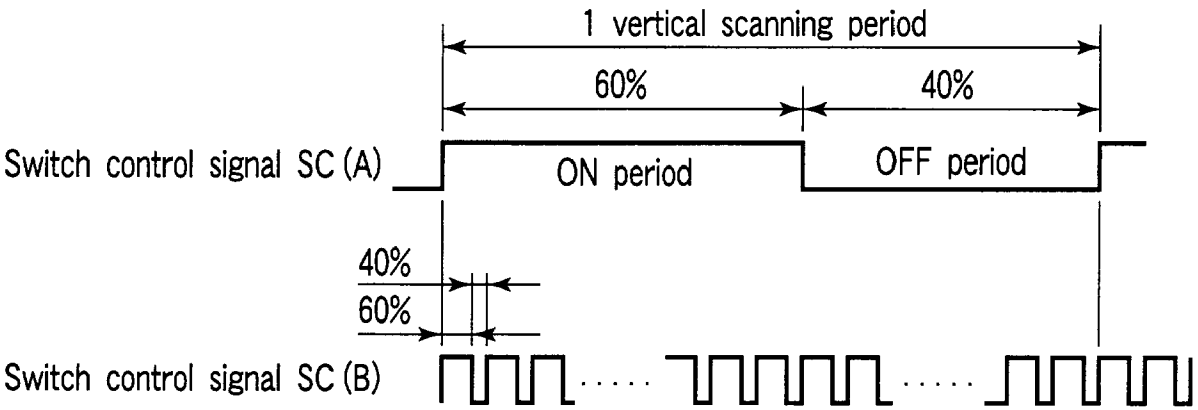
FIG. 14 is a timing chart showing two types of switch control signals used to set the ratio of the ON period to the OFF period of the dimmer switch portion shown in FIGS. 12 to 60%:40%.

Further, in the luminance adjusting operation of setting the luminance of the screen to 60%, a switch control signal SC(A) as shown in FIG. 14 is supplied to the dimmer switch portion 34. In the case of the switch control signal SC(A), the preceding 6/10 portion of one vertical scanning period is set as an ON period for supply of a driving current and the remaining 4/10 portion thereof succeeding the above period is set as an OFF period for interruption of the driving current. The dimmer switch portion 34 performs a switching operation only once in one vertical scanning period under control of the switch control signal SC(A). As a result, the ratio of the luminous time to the non-luminous time of all the organic EL elements 16 is set to 3:2 so as to set the luminance of the screen to 60% of the maximum luminance.

In the above embodiment, the switch control signal SC(A) which causes the dimmer switch portion 34 to perform the switching operation once in one vertical scanning period is explained. However, as shown in FIGS. 13 and 14, a switch control signal SC(B) which causes the dimmer switch portion 34 to perform the switching operation plural times in one vertical scanning period can be used. Also, with the switch control signal SC(B), the ratio of the ON period to the OFF period can be controlled in the unit of one vertical scanning period.

In the organic EL display device of the embodiment, the dimmer switch portion 34 switches driving currents flowing in all of the organic EL elements 16 in each vertical scanning period under control of the switch control signal SC to control the ratio of the luminous time to the non-luminous time of the organic EL elements 16 to adjust the luminance of the screen. This system can avoid degradation in the white balance that occurs due to a difference between the luminance characteristics of the organic EL elements 16 depending on the luminescent colors when the driving currents flowing in all of the organic EL elements 16 are not interrupted and changed in each vertical scanning period to adjust the luminance of each organic EL element 16. That is, the luminance of the display screen can be adjusted without degradation in the white balance. Further, since the controller 32 controls the switching operation of the single dimmer switch portion 34 to determine the ratio of the luminous time to the non-luminous time of all the organic EL elements 16, the complicated structure such as a correction circuit for correcting a variation amount of a video signal level is not required to maintain the white balance.

The dimmer signal can be configured not only to reflect a selection result of a desired luminance but also to reflect the remaining battery power or the illuminance of incident light to the organic EL panel 10 from the exterior, for example. Further, the luminance of the screen can be controlled to be lowered when the video signal is kept unchanged for a preset period of time by interruption of the computer operation. Also, the above dimmer switch portion 34 is formed of a thin-film transistor using a polycrystalline silicon thin film and formed on the same insulating substrate GL at the same process as that of the pixel switches 15, driving transistors 17, and drivers YD, XD.

Figure 15:
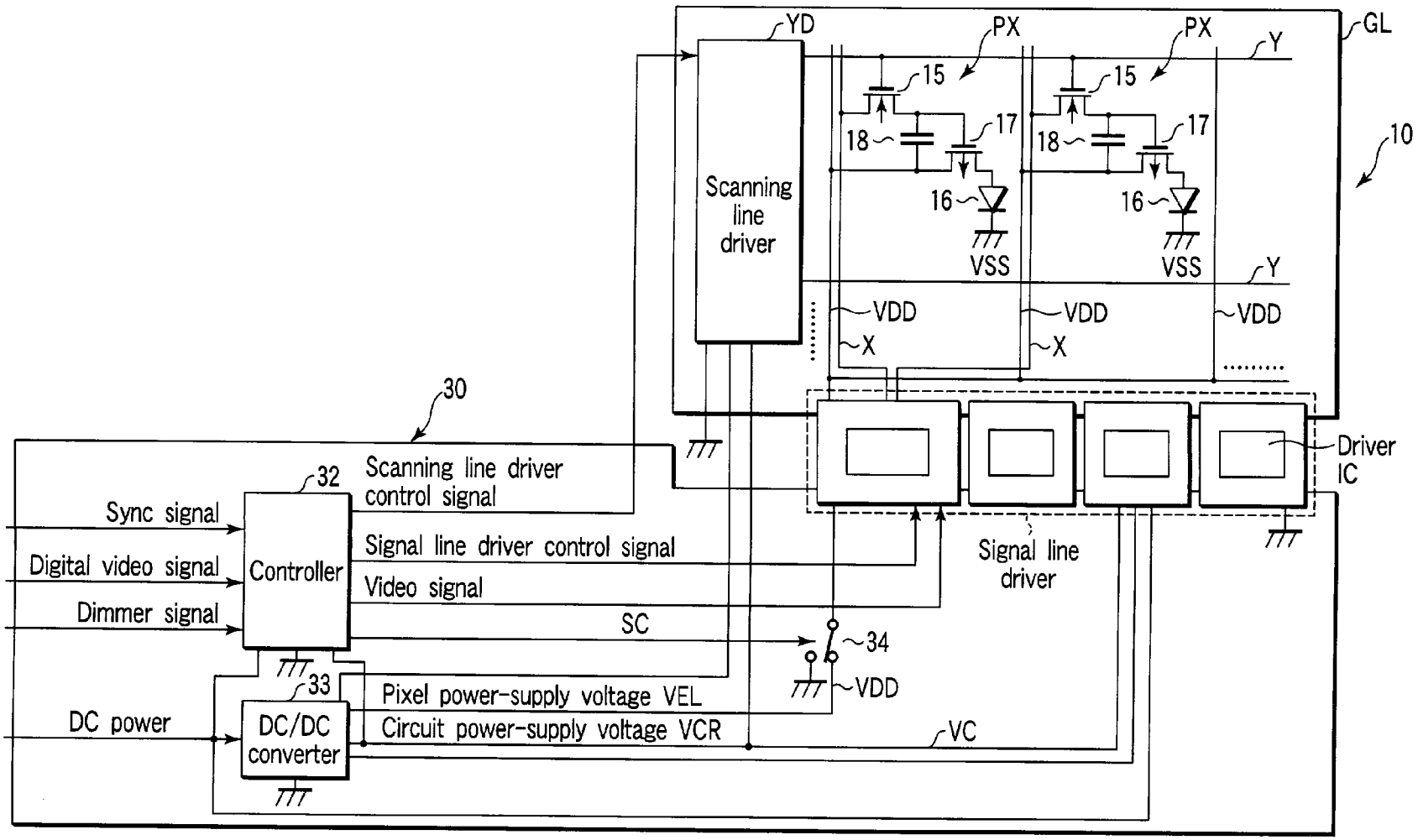
FIG. 15 is a circuit diagram showing the configuration of an organic EL display device according to a sixth embodiment of the present invention.

FIG. 15 shows the configuration of an organic EL display device according to a sixth embodiment of the present invention. The organic EL display device is similar to the organic EL display device of the fifth embodiment except that the dimmer switch portion 34 is formed as an output enable switch of pixel power-supply voltage VEL on the board of the external drive circuit 30 disposed outside the organic EL panel 10. In FIG. 15, portions which are similar to those of FIG. 12 are denoted by the same reference symbols and the explanation thereof is omitted.

The dimmer switch portion 34 is inserted between an output node for pixel power-supply voltage VEL and a power line VDD and controlled by a switch control signal SC from a controller 32, as in the fifth embodiment. That is, the dimmer switch portion 34 is set into a first state in which it connects the power line VDD to the output node for pixel power-supply voltage VEL to cause all of the organic EL elements 16 to emit light when the switch control signal SC is set at the high level, and set into a second state in which it connects the power line VDD to the power line VSS to interrupt light emission of all of the organic EL elements 16 when the switch control signal SC is set at the low level. The controller 32 determines the luminance level based on a dimmer signal supplied from the exterior to change the ratio of the high-level period to the low-level period of the switch control signal SC in each vertical scanning period according to the luminance level. The dimmer switch portion 34 switches driving currents which respectively flow in all of the organic EL elements 16 under control of the switch control signal SC to equally control the ratios of the luminous time to the non-luminous time of all the organic EL elements 16 to adjust the luminance of the display screen.

In this case, the controller 32 receives a digital video signal and sync signal supplied from the exterior and produces a scanning line driver control signal for controlling the vertical scanning timing, a signal line driver control signal for controlling the horizontal scanning timing, and a DAC control signal synchronized with the horizontal and vertical scanning timings, based on the sync signal. Further, the controller 32 respectively supplies the scanning line driver control signal, signal line driver control signal and DAC control signal to the scanning line driver YD, signal line driver XD and DAC 31 and also supplies a digital video signal to the DAC 31 in synchronism with the horizontal and vertical scanning timings. The scanning line driver YD is formed on an insulating substrate GL and connected to the scanning lines Y which are integrally formed with the scanning line driver YD on the insulating substrate GL. Further, the signal line driver XD and DAC 31 are formed of driver ICs disposed on a flexible wiring board as a TCP (tape carrier package) and connected to the signal lines X formed on the insulating substrate GL. In the driver ICs, the DAC 31 sequentially converts a digital video signal into an analog form by control of the DAC control signal, and the signal line driver XD samples the analog video signals derived from the DAC 31 in each horizontal scanning period by control of the horizontal scanning control signal and supplies the sampled signals to corresponding ones of the signal lines X in parallel.

In the organic EL display device of the sixth embodiment, the dimmer switch portion 34 is disposed on the external drive circuit board, and switches driving currents flowing in all of the organic EL elements 16 in each vertical scanning period by control of the switch control signal SC, as in the first embodiment, to equally control the ratios of the luminous time to the non-luminous time of all the organic EL elements 16. Therefore, the luminance of the display screen can be adjusted without degrading the white balance. Further, since the controller 32 controls the switching operation of the single dimmer switch portion 34 to determine the ratio of the luminous time to the non-luminous time of all the organic EL elements 16, the complicated structure such as a correction circuit for correcting a variation amount of a video signal level is not required to maintain the white balance.

In this case, the arrangement of the DAC 31, scanning line driver YD and signal line driver XD has no relation with respect to the configuration having the dimmer switch portion 34 formed on the board of the external drive circuit 30, thus the configuration is applicable to the fifth embodiment.

Figure 16:
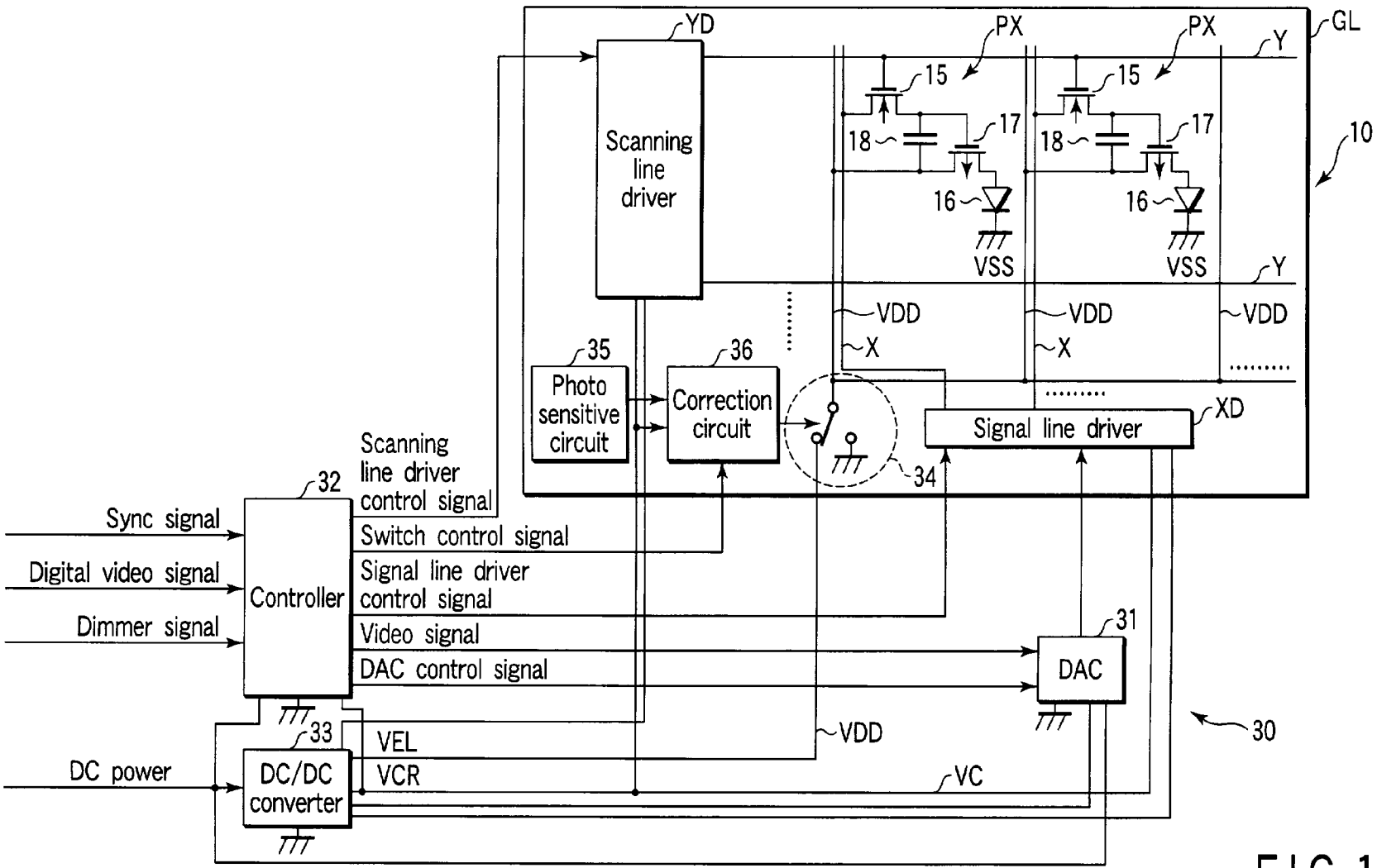
FIG. 16 is a circuit diagram showing the configuration of an organic EL display device according to a seventh embodiment of the present invention.

FIG. 16 shows the configuration of an organic EL display device according to a seventh embodiment of the present invention. The organic EL display device is similar to the organic EL display device of the fifth embodiment except that a photosensitive element 35 and correction circuit 36 are further formed on an insulating substrate GL of an organic EL panel 10 in order to control a dimmer switch portion 34. The organic EL display device is of an upper-surface luminescent type in which light is emitted from the organic EL element to the exterior on the upper-surface side of the insulating substrate GL. In FIG. 16, portions which are similar to those of FIG. 12 are denoted by the same reference symbols and the explanation thereof is omitted.

The photosensitive element 35 receives light applied to the organic EL panel 10 from the exterior. The correction circuit 36 corrects a switch control signal SC from a controller 32 based on an output signal of the photosensitive element 35, so that the dimmer switch portion 34 is controlled according to the switch control signal SC obtained as the result of correction.

In the organic EL display device of the seventh embodiment, it is possible to prevent a display image from becoming difficult to observe due to the illumination of the service environment of the organic EL panel 10 when the luminance level of the display screen is determined based on the dimmer signal.

In the above example, the correction circuit 36 can be configured to correct the switch control signal SC based on a desired signal supplied from a selection circuit which is operated by a user or an external computer, instead of a signal from the photosensitive element 35 which receives light applied to the organic EL panel 10 from the exterior.

Figure 17:
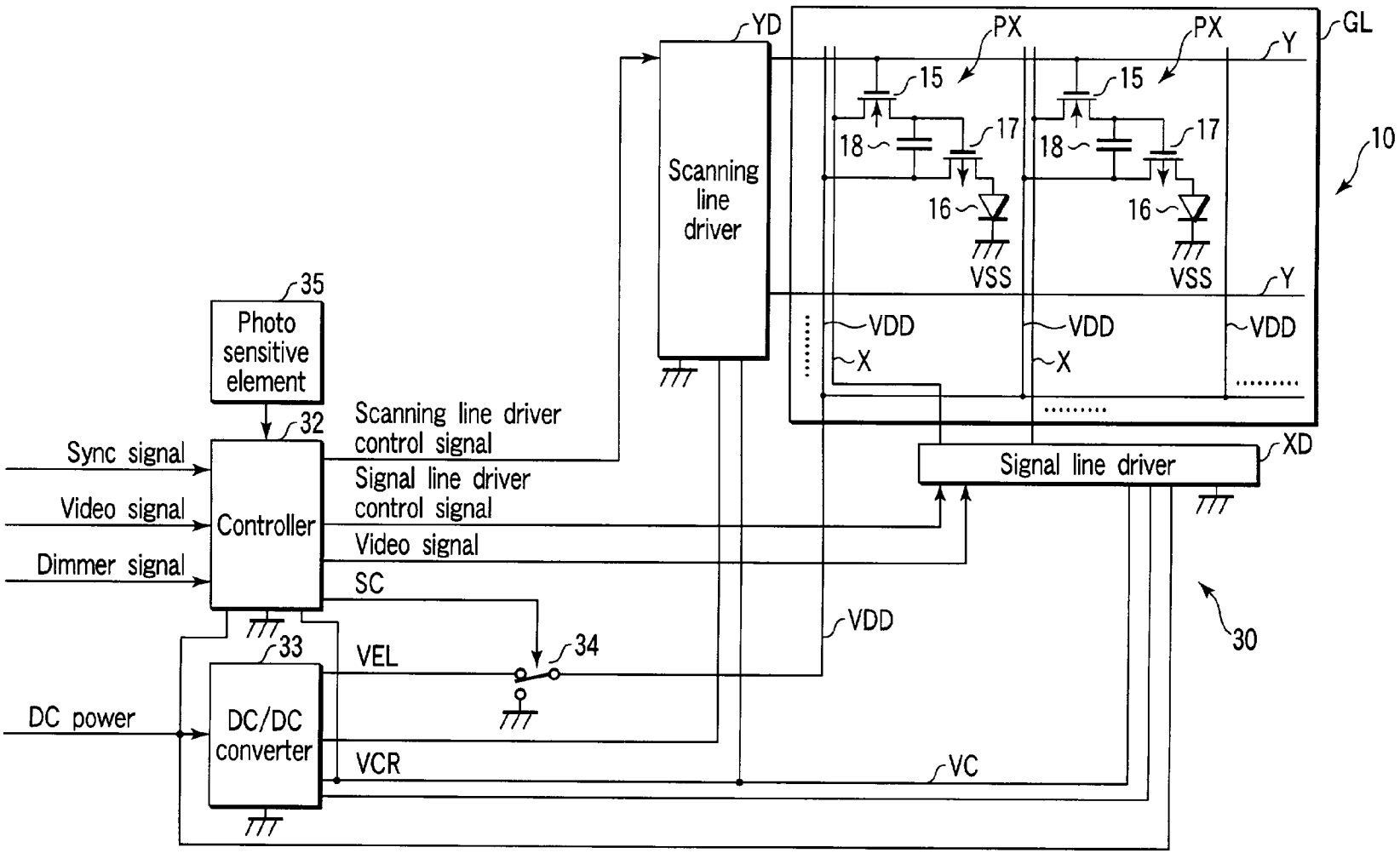
FIG. 17 is a circuit diagram showing the configuration of an organic EL display device according to an eighth embodiment of the present invention.

FIG. 17 shows the configuration of an organic EL display device according to an eighth embodiment of the present invention. The organic EL display device is similar to the organic EL display device of the sixth embodiment except that a photosensitive element 35 is formed as part of the external drive circuit 30. In FIG. 17, portions which are similar to those of FIG. 12 are denoted by the same reference symbols and the explanation thereof is omitted.

The photosensitive element 35 receives light applied to the organic EL panel 10 from the exterior. The correction circuit 36 corrects a switch control signal SC from a controller 32 based on an output signal of the photosensitive element 35, so that the dimmer switch portion 34 is controlled according to the switch control signal SC obtained as the result of correction.

In the organic EL display device of the eighth embodiment, it is possible to prevent a display image from becoming difficult to observe due to the illumination of the service environment of the organic EL panel 10 when the luminance of the display screen is determined based on the dimmer signal.

In the above embodiment, the dimmer switch portion 34 performs the control operation of setting all of the organic EL elements 16 in one of the luminous and non-luminous states. If a node on the display pixel PX side forming the power line VDD on the insulating substrate GL is connected to a node on the DC/DC converter 33 side via the dimmer switch portion 34, driving currents are supplied to the organic EL elements 16 to set them in the luminous state. On the other hand, if the node on the display pixel PX side is connected to the power line VSS via the dimmer switch portion 34, supply of driving currents is interrupted to set the organic EL elements 16 in the non-luminous state. The dimmer switch portion 34 is not limited to the above configuration and it can be so configured as to connect the node on the display pixel PX side to a second pixel power-supply voltage line which is provided to supply a minute current so as to maintain the organic EL elements 16 in the non-luminous state, for example.

Figure 18:
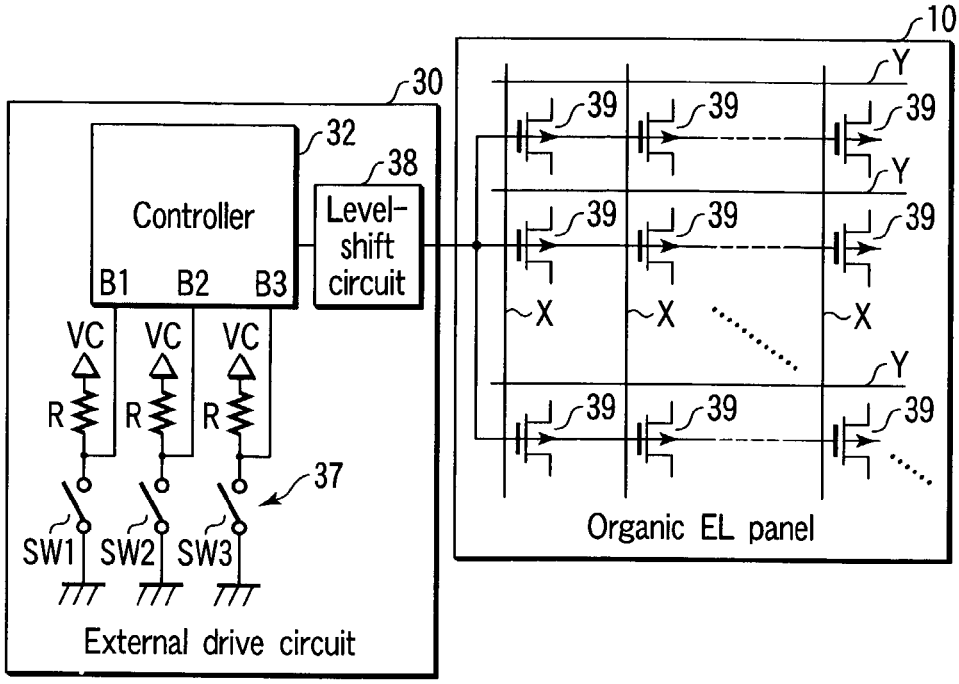
FIG. 18 is a circuit diagram schematically showing the configuration of an organic EL display device according to a ninth embodiment of the present invention.

FIG. 18 schematically shows the configuration of an organic EL display device according to a ninth embodiment of the present invention. The organic EL display device is similar to the organic EL display device of the first embodiment except that the external drive circuit 30 is modified to digitally adjust the luminance of the display screen. Further, a plurality of dimmer transistors 39 are formed instead of the dimmer switch portion 34 in the display region. In FIG. 18, portions which are similar to those of FIG. 12 are denoted by the same reference symbols and the explanation thereof is omitted. Further, the organic EL display device includes a DAC 31, DC/DC converter 33, scanning line driver YD, signal line driver XD which are the same as those of FIG. 12 although they are not shown in FIG. 18 for simplicity of the drawing.

In the organic EL display device, the external drive circuit 30 further includes a luminance selection section 37 and level-shift circuit 38. A controller 32 and the level-shift circuit 38 are formed as an integrated circuit. The level-shift circuit 38 is used to convert the level of a switch control signal SC obtained from the controller 32 to a gate voltage which is required for the switching operation of the dimmer transistors 39. The luminance selection section 37 includes manual switches SW1 to SW3 which are each connected to the power line VSS at one end and respectively connected to a power line VC at the other ends via pull-up resistors R. Nodes of the pull-up resistors R and manual switches SW1 to SW3 are respectively connected to luminance selection terminals B1 to B3 of the controller 32. The manual switches SW1 to SW3 are closed when the luminance selection terminals B1 to B3 are set to a logic value "0" and opened when the luminance selection terminals B1 to B3 are set to a logic value "1". That is, the manual switches SW1 to SW3 are controlled by combinations of logic values of "000", "001", "010", "101", "111", "101", "110", "111" to create a switch control signal SC which can be used to select one of eight-step luminance levels. The controller 32 receives the combination of the logic values obtained from the luminance selection section 37 as a dimmer signal instead of the dimmer signal from the exterior. Then, it sets one of the eight-step luminance levels selected by the thus received dimmer signal and changes the ratio of the high-level period to the low-level period of the switch control signal SC in each vertical scanning period according to the thus set luminance level. When the switch control signal SC is received from the controller 32, it is level-shifted by the level-shift circuit 38 and supplied to the gates of the dimmer transistors 39 of the organic EL panel 10.

Figure 19:
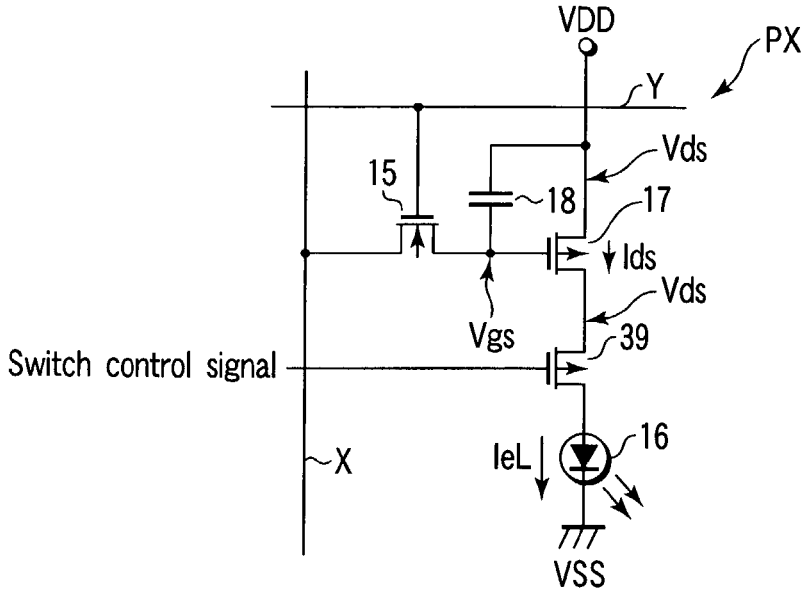
FIG. 19 is a circuit diagram showing the configuration of a display pixel around a dimmer switch shown in FIG. 18.

The plurality of dimmer transistors 39 are provided for the plurality of display pixels PX and commonly controlled by the switch control signal SC obtained from the controller 32 of the external drive circuit 30. As shown in FIG. 19, each of the dimmer transistors 39 is connected in series with the organic EL element 16 and driving transistor 17 between the paired power lines VDD and VSS. In this example, a pixel switch 15 is formed of an N-channel thin-film transistor, and the driving transistor 17 and dimmer transistors 39 are each formed of a P-channel thin-film transistor. In this case, the dimmer transistors 39 are set into the ON state to cause all of the organic EL elements 16 to emit light when the switch control signal SC is an ON signal (low level), and set into the OFF state to interrupt light emission of all of the organic EL elements 16 when the switch control signal SC is an OFF signal (high level). The controller 32 determines a luminance level based on the dimmer signal supplied from the exterior to change the ratio of the high-level period to the low-level period of the switch control signal SC in each vertical scanning period according to the thus set luminance level. The dimmer transistors 39 switch driving currents flowing in all of the respective organic EL elements 16 under control of the switch control signal SC to equally control the ratios of the luminous time to the non-luminous time of the organic EL elements 16 and adjust the luminance of the screen.

Figure 20:
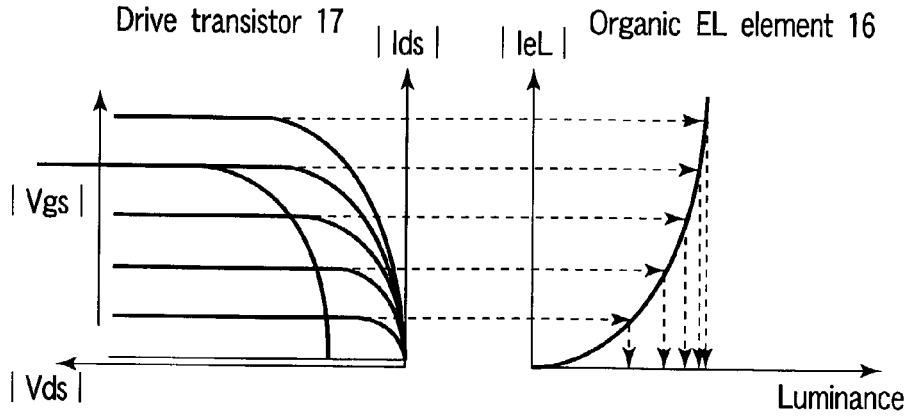
FIG. 20 is a graph showing the luminance characteristic of an organic EL element shown in FIG. 19 together with the operating characteristic of a driving transistor.

Next, the operation of each display pixel PX is explained in detail. FIG. 20 shows the luminance characteristic of the organic EL element 16 together with the operating characteristic of the driving transistor 17. In FIG. 20, the operating characteristic of the driving transistor 17 is shown with the drain-source voltage Vds of the driving transistor 17 used as a parameter and it is understood that the drain-source current Ids of the driving transistor 17 varies depending on the gate-source voltage Vgs of the driving transistor 17. In this case, the drain-source voltage Vds of the driving transistor 17 depends on video signal voltage and the drain-source current Ids of the driving transistor 17 is equal to a current IeL of the organic EL element 16. Therefore, if the dimmer transistor 39 is set in the ON state, the organic EL element 16 emits light with a luminance level corresponding to the current IeL which varies according to the video signal voltage.

Figure 21:
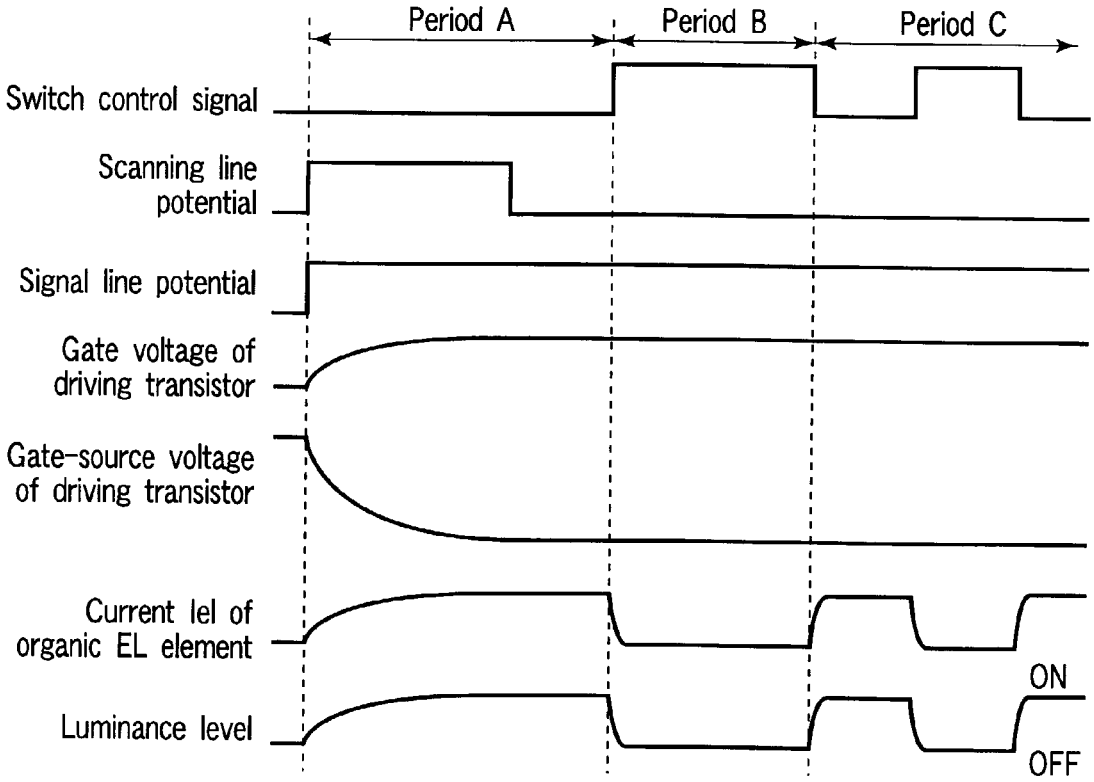
FIG. 21 is a waveform diagram showing the waveforms in the display pixel operated under control of a dimmer transistor shown in FIG. 19.

FIG. 21 shows the operation waveforms in the display pixel PX by control of the dimmer transistor 39. In order to attain 100% of the luminance of the display screen, the switch control signal SC is maintained at the low level to always keep the dimmer transistor 39 in the ON state in a period A, for example. If the pixel switch 15 is turned ON by the potential of a signal line Y which rises at the time of supply of the scanning signal in the period A, for example, the potential of a signal line X corresponding to the video signal of the maximum gradation level is supplied to the gate of the driving transistor 17 via the pixel switch 15. As a result, the gate-source voltage Vgs of the driving transistor 17 is lowered with a rise of the gate voltage. During this time period, a driving current flows through the driving transistor 17, dimmer transistor 39 and organic EL element 16 between the power lines VDD and VSS and increases to the maximum level so as to cause the organic EL element 16 to emit light at a luminance level which sets the luminance of the display screen to 100%. Since the gate voltage of the driving transistor 17 is held by a capacitor 18, the driving current continuously flows through the organic EL element 16 even after the pixel switch 15 is turned OFF by a fall of the potential of the scanning line Y. That is, the dimmer transistor 39 will not totally interrupt the current IeL flowing in the organic EL element 16 in the period A.

Further, in order to attain 0% of the luminance of the display screen, the switch control signal SC is maintained at the high level to always keep the dimmer transistor 39 in the OFF state in a period B, for example. Thus, the dimmer transistor 39 totally interrupts the current IeL flowing in the organic EL element 16 in the period B irrespective of the driving transistor 17.

Also, in order to attain 50% of the luminance of the display screen, the switch control signal SC is set to have a high-level period and low-level period of the ratio which is set to 1:1 to uniformly perform the operation of setting the dimmer transistor 39 in the ON state and the operation of setting the dimmer transistor 39 in the OFF state in a period C, for example. Thus, the dimmer transistor 39 interrupts the current IeL flowing in the organic EL element 16 for a period which is half a period obtained as the sum of the high-level period and low-level period in the period C.

Figures 22A, 22B, 22C:
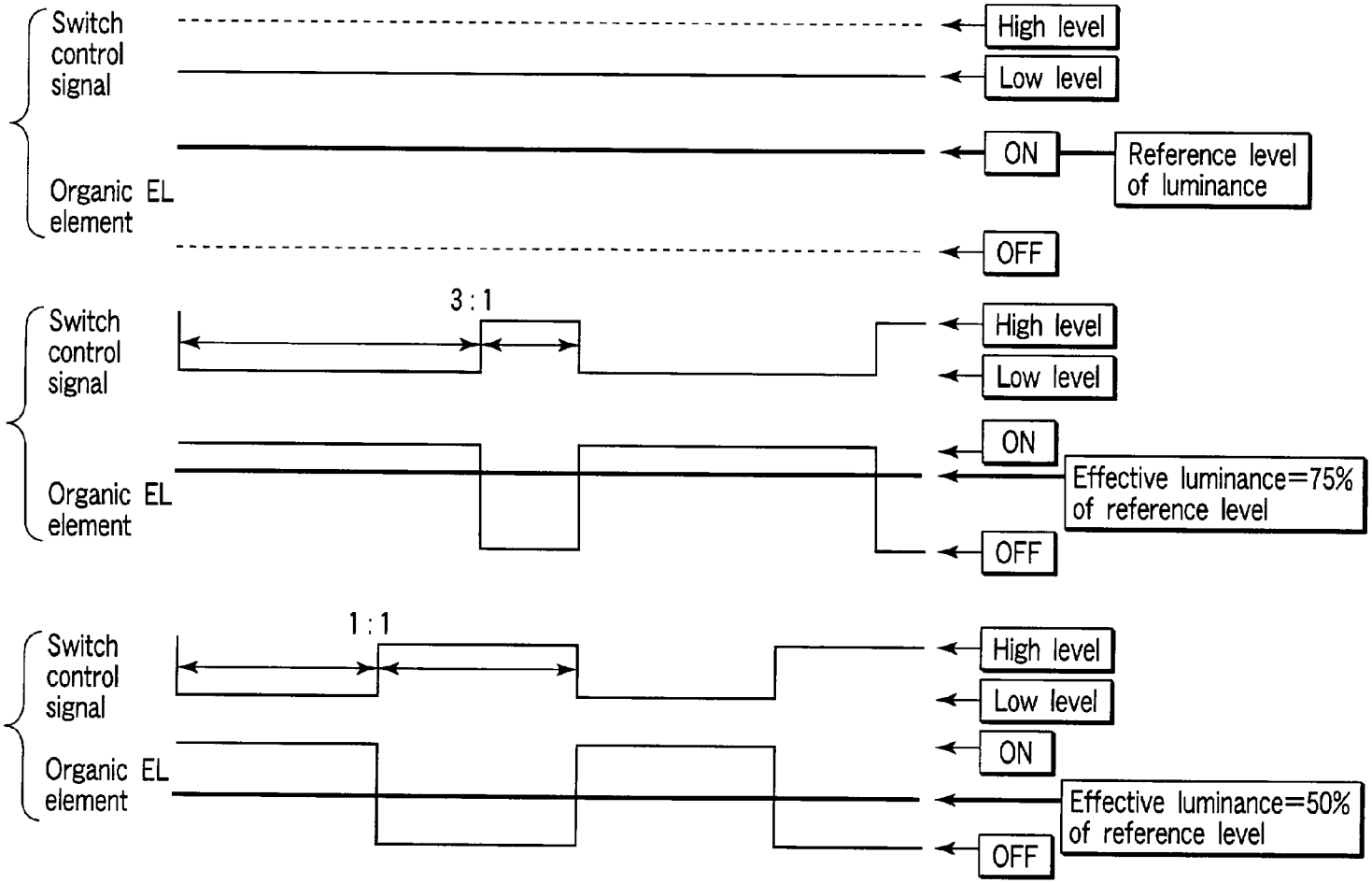
FIGS. 22A to 22C are timing charts for illustrating the luminance of the organic EL element controlled according to a switch control signal shown in FIG. 19.

FIGS. 22A to 22C show the effective luminance level of the organic EL element 16 which is obtained according to the switch control signal SC used to determine the ratio of the ON period to the OFF period of the dimmer transistor 39. As shown in FIG. 22A, when the switch control signal SC is maintained at the high level which causes the dimmer transistor 39 to be kept in the ON state, the organic EL element 16 always emits light at a luminance level corresponding to the current IeL determined by the driving transistor 17. The luminance level is used as a reference level to adjust the luminance of the display screen.

As shown in FIG. 22B, when the switch control signal SC is alternately set at the high and low levels so as to set the ratio of the ON time to the OFF time of the dimmer transistor 39 to 3:1, the organic EL element 16 intermittently emits light at a luminance level corresponding to the current IeL determined by the driving transistor 17. At this time, the ratio of the luminous time to the non-luminous time of the organic EL element 16 is set to 3:1 according to the switch control signal SC. However, since the sense of vision of an observer has an afterimage effect, it is observed as if the organic EL element 16 always emits light at a luminance level corresponding to 75% of the reference level according to the above time ratio. That is, the luminance of the display screen can be adjusted to 75% by commonly controlling the ratio of the ON period to the OFF period of all of the organic EL elements 16 according to the switch control signal SC as described above.

Further, as shown in FIG. 22C, when the switch control signal SC is alternately set at the high and low levels so as to set the ratio of the ON time to the OFF time of the dimmer transistor 39 to 1:1, the organic EL element 16 intermittently emits light at a luminance level corresponding to the current IeL determined by the driving transistor 17. At this time, the ratio of the luminous time to the non-luminous time of the organic EL element 16 is set to 1:1 according to the switch control signal SC. However, since the sense of vision of an observer has the afterimage effect, it is observed like the case of FIG. 22B as if the organic EL element 16 always emits light at a luminance level corresponding to 50% of the reference level according to the above time ratio. That is, the luminance of the display screen can be adjusted to 50% by commonly controlling the ratio of the ON period to the OFF period of all of the organic EL elements 16 according to the switch control signal SC.

In the ninth embodiment described above, the luminance of the display screen can be adjusted to a desired one of the eight-step levels by use of three or a relatively small number of manual switches.

Figure 23:
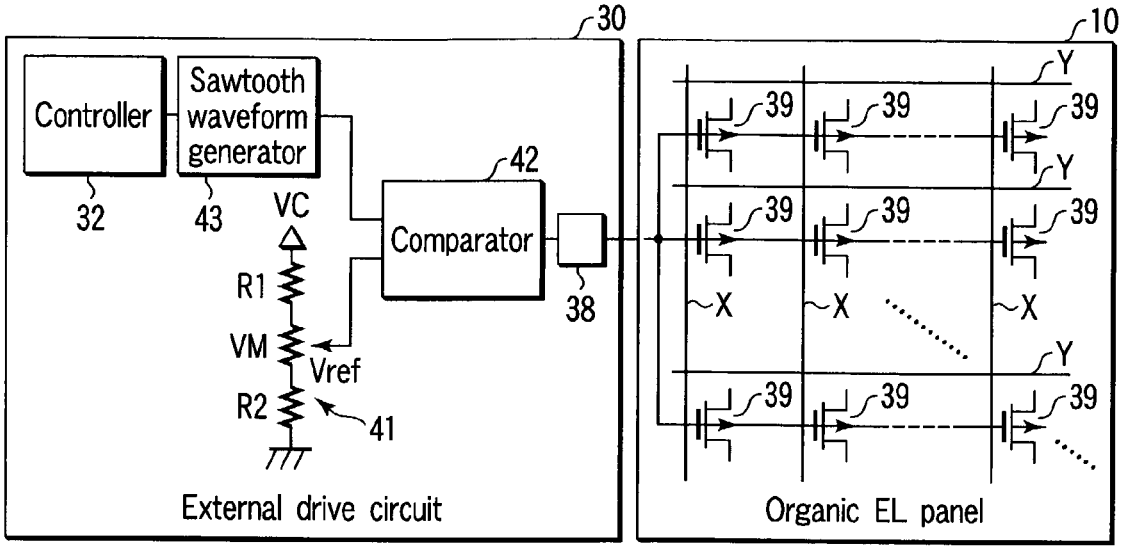
FIG. 23 is a circuit diagram schematically showing the configuration of an organic EL display device according to a tenth embodiment of the present invention.

FIG. 23 schematically shows the configuration of an organic EL display device according to a tenth embodiment of the present invention. The organic EL display device is similar to the organic EL display device of the fifth embodiment except that the external drive circuit 30 is modified to adjust the luminance of the display screen in an analog fashion. In FIG. 23, portions which are similar to those of FIG. 12 are denoted by the same reference symbols and the explanation thereof is omitted. Further, the organic EL display device includes a DAC 31, DC/DC converter 33, scanning line driver YD, signal line driver XD which are the same as those of FIG. 12 although they are not shown in FIG. 23 for simplicity of the drawing.

In the organic EL display device, the external drive circuit 30 further includes a level-shift circuit 38, luminance selection section 41, sawtooth waveform generator 43 and comparator 42. Like the ninth embodiment, a controller 32 and the level-shift circuit 38 are formed as an integrated circuit. The level-shift circuit 38 is used to convert the level of a switch control signal SC obtained from the controller 32 to a gate voltage which is required for the switching operation of dimmer transistors 39. The luminance selection section 41 has fixed resistors R1, R2 and a variable resistor VM to configure a voltage dividing circuit which divides power-supply voltage VCR. The variable resistor VM is connected to a power line VC at one end via the fixed resistor R1 and connected to a power line VSS at the other end via the resistor R2 and an intermediate tap of the variable resistor VM is connected to the reference input terminal of the comparator 42. The comparison input terminal of the comparator 42 is connected to the sawtooth waveform generator 43 which generates sawtooth voltage Vsaw. The sawtooth waveform generator 43 generates sawtooth voltage Vsaw in synchronism with at least one of a vertical scanning control signal and horizontal scanning control signal generated by the controller 32. In this case, the period of the sawtooth voltage Vsaw is shorter than the vertical scanning period. The comparator 42 compares the sawtooth voltage Vsaw generated from the sawtooth waveform generator 43 with divided voltage obtained from the intermediate tap of the variable resistor VM as comparison reference voltage Vref to generate a switch control signal SC. The switch control signal SC is set at the low level when Vref>Vsaw and set at the high level when Vref<Vsaw.

Figure 24A:
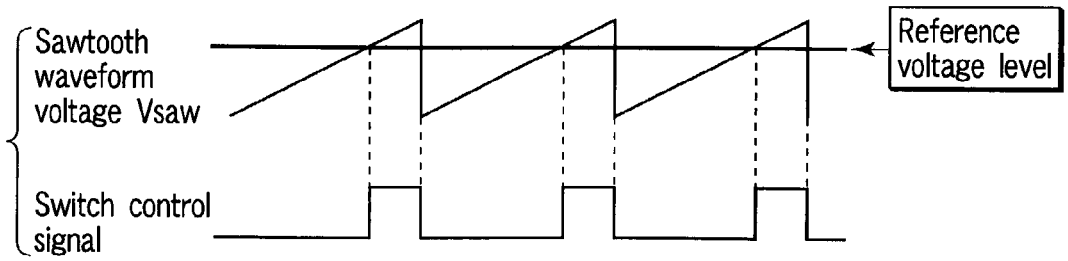
FIGS. 24A and 24B are waveform diagrams showing the waveforms of switch control signals generated based on the relation between sawtooth voltage and reference voltage which are input to a comparator shown in FIG. 23.
Figure 24B:
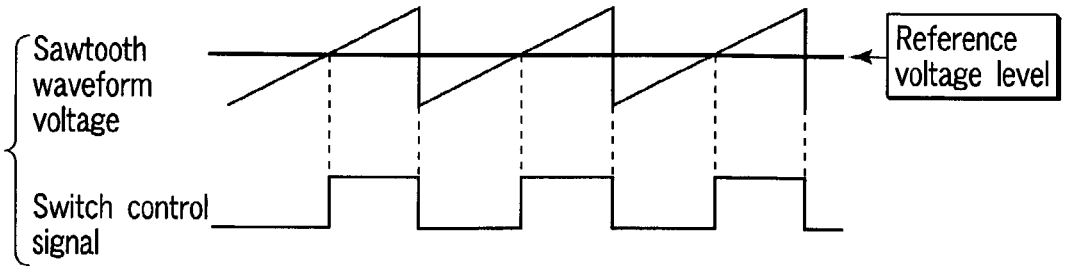

For example, as shown in FIG. 24A, if the reference voltage Vref is set at the relatively high level, the high-level period becomes shorter than the low-level period in the switch control signal SC. On the other hand, for example, as shown in FIG. 24B, if the reference voltage Vref is set at the intermediate level, the high-level period becomes approximately equal to the low-level period in the switch control signal SC. The switch control signal SC is level-shifted by the level-shift circuit 38 and supplied to the gates of the dimmer transistors 39 of the organic EL panel 10.

In the tenth embodiment, the ratio of the high-level period to the low-level period of the switch control signal SC can be changed by continuously changing the reference voltage Vref by the manual operation of the variable resistor VM. Therefore, the luminance of the display screen can be continuously adjusted.

Figure 25:
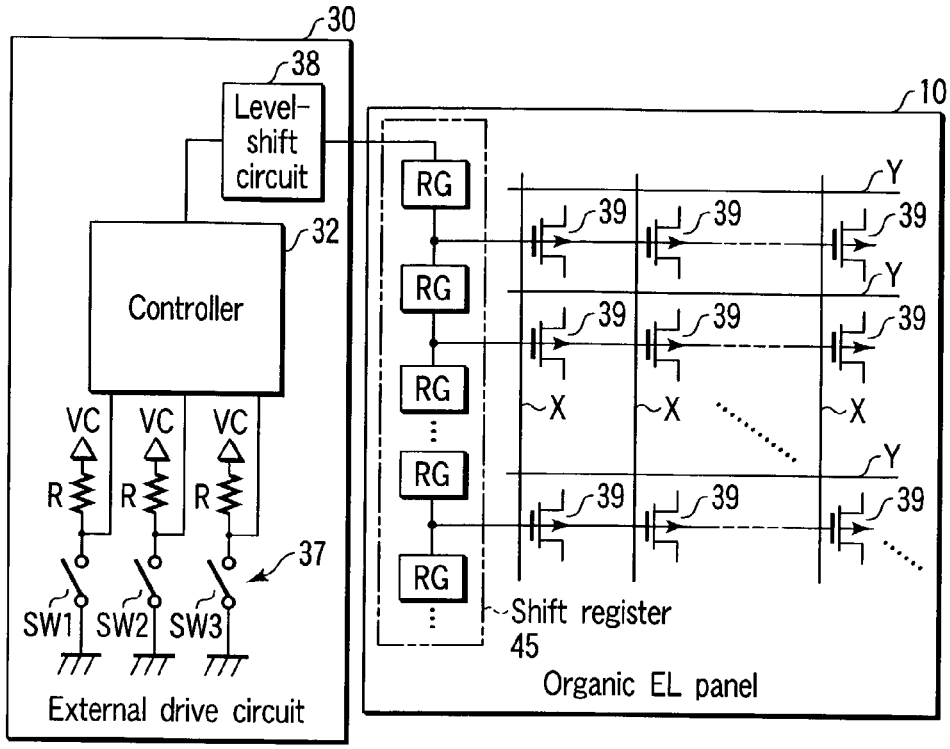
FIG. 25 is a circuit diagram schematically showing the configuration of an organic EL display device according to an eleventh embodiment of the present invention.

FIG. 25 schematically shows the configuration of an organic EL display device according to an eleventh embodiment of the present invention. The organic EL display device is similar to the organic EL display device of the ninth embodiment except that the organic EL panel 10 is modified so that a plurality of dimmer transistors 39 will be driven for each row. In FIG. 25, portions which are similar to those of FIG. 18 are denoted by the same reference symbols and the explanation thereof is omitted. Further, the organic EL display device includes a DAC 31, DC/DC converter 33, scanning line driver YD, signal line driver XD which are the same as those of FIG. 12 although they are not shown in FIG. 25 for simplicity of the drawing.

In the organic EL display device, the organic EL panel 10 further includes a plurality of registers RG cascade-connected to configure a shift register 45 which shifts a switch control signal SC supplied from a controller 32 via a level-shift circuit 38. For example, the controller 32 is so configured as to change the level of the switch control signal SC at a timing synchronized with the horizontal scanning period. When the ratio of the high-level period to the low-level period of the switch control signal SC is set to 3:1, the controller 32 continuously sets the switch control signal SC at the high level for a period corresponding to three horizontal scanning periods and continuously sets the switch control signal SC at the low level for one horizontal scanning period following the above period. The shift register 45 shifts the switch control signal SC for each horizontal scanning period by control of the horizontal scanning control signal from the controller 32 and respectively supplies switch control signals SC from the registers RG to the dimmer transistors 39 of the corresponding rows.

In the above eleventh embodiment described above, since all of the dimmer transistors 39 are not simultaneously turned ON, a temporary increase in the power consumption can be prevented and the power supply ability of the DC/DC converter 33 can be lowered.

Figure 26:
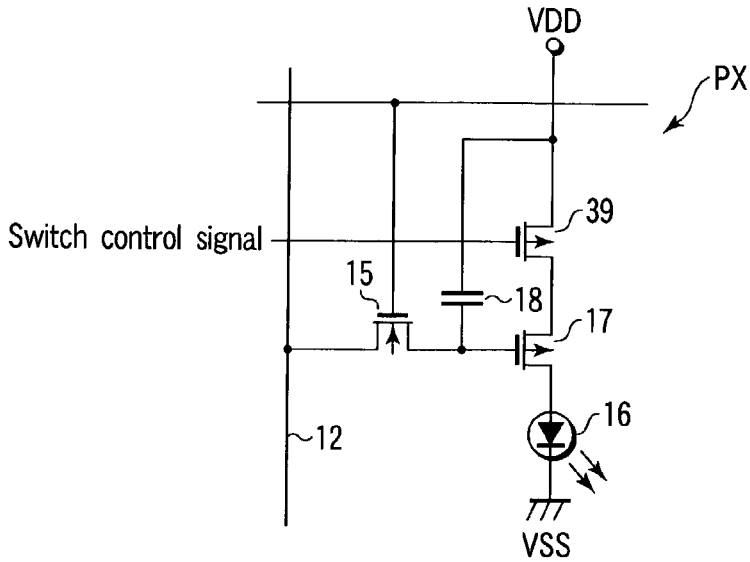
FIG. 26 is a circuit diagram showing a first modification of the display pixel shown in FIG. 19.

FIG. 26 shows a first modification of the display pixel PX shown in FIG. 19. In the first modification, the dimmer transistor 39 is connected between the power line VDD and the driving transistor 17. With this configuration, the dimmer transistor 39 switches a driving current flowing in the organic EL element 16 by control of the switch control signal SC so as to control the ratio of the luminous time to the non-luminous time of the organic EL element 16.

Figure 27:
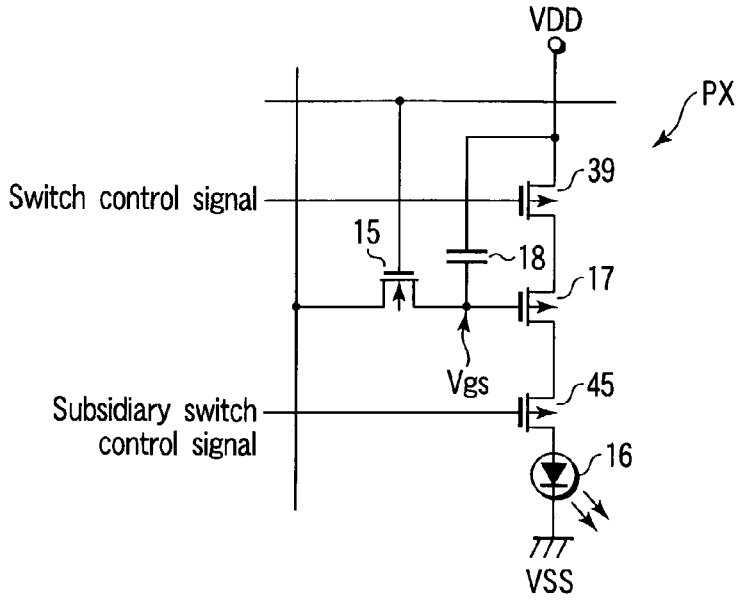
FIG. 27 is a circuit diagram showing a second modification of the display pixel shown in FIG. 19.
Figure 28:
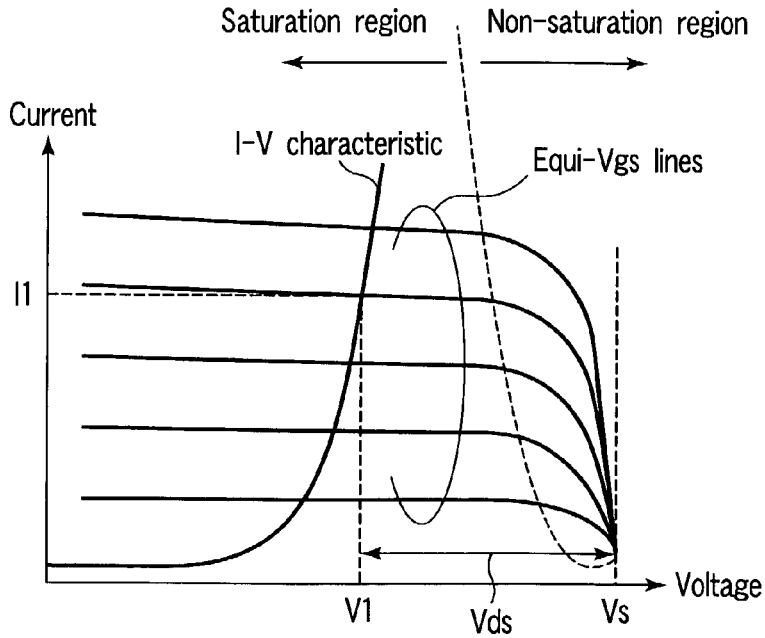
FIG. 28 is a graph showing the relation between the driving current and the gate-source voltage of a driving thin-film transistor which is conventionally known.

FIG. 27 shows a second modification of the display pixel PX shown in FIG. 19. In the second modification, the dimmer transistor 39 is connected between the power line VDD and the driving transistor 17 and a dimmer transistor 46 is connected between the driving transistor 17 and the anode of the organic EL element 16. The dimmer transistor 39 switches a driving current flowing in the organic EL element 16 by control of the switch control signal SC and the dimmer transistor 46 switches a driving current flowing in the organic EL element 16 by control of a subsidiary switch control signal SC'. With this configuration, the ratio of the luminous time to the non-luminous time of the organic EL element 16 controlled by the switch control signal SC can be further controlled by use of the subsidiary switch control signal SC'. Thus, the dimmer transistor 46 can be controlled by the subsidiary switch control signal SC' so as to reflect the illumination of the service environment on the luminance of the display screen.

This invention is not limited to the above embodiments and can be variously modified without departing from the technical scope thereof. For example, a plurality of organic EL elements 16 can be replaced by other luminous elements such as self-luminous LEDs. Further, the present invention uses the dimmer switch portion 34 or dimmer transistors 39, 46 to maintain the relation between the white balances of the display pixels having different luminescent colors, but the configuration is also applicable to a case where the luminescent colors of the display pixels are the same.

In the above embodiments, a case wherein the DAC is formed on the external drive circuit board or formed in the TCP form as the driver IC is explained. However, it can be integrated on the insulating substrate on which the pixel transistors are formed and it can be formed in the same process of forming the pixel transistors and driving transistors.

Further, in the above embodiments, a case wherein the driving current amount is controlled based on the video signal to attain multi-gradation display is explained, but this is not limitative. For example, the present invention is applicable to a case of a pulse width modulation drive system in which a driving current flowing in the organic EL element is kept constant and time of supply of the driving current is controlled to perform gradation display. In the case of the pulse width modulation drive system, the ratio in the switch control signal is set so that the luminance can be adjusted at the time of minimum pulse width.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A self-luminous display device comprising:

a plurality of luminous elements forming a display screen;

a driving signal supply section which supplies driving signals to said luminous elements; and a luminance adjusting section which equally changes the ratios of luminous time to non-luminous time of said luminous elements by switching the driving signals from said driving signal supply section to adjust luminance of the display screen;

wherein said driving signal supply section includes a plurality of element driving sections which respectively change the driving signals of said plurality of luminous elements according to a video signal, said luminance adjusting section includes a dimmer switch portion which switches the driving signal at least once in an updating period of the video signal to adjust the luminance of the display screen, said dimmer switch portion including at least one dimmer switch, each dimmer switch configured to switch the driving signal of a plurality of said luminous elements; and wherein said luminous elements are formed together with said element driving section on a single panel, and each of said element driving sections includes a driving transistor which is connected in series with a corresponding one of said luminous elements between paired power lines and causes a driving signal corresponding to the gate voltage thereof to flow through the corresponding luminous element, a pixel switch which applies a voltage of the video signal to the driving transistor as the gate voltage thereof, and a capacitor which holds the gate voltage of the driving transistor.

2. The self-luminous display device according to claim 1, further comprising an external drive circuit including a power supply circuit which supplies a power-supply voltage to the paired power lines and a switch control signal generator which generates a switch control signal used to determine ratios of luminous time to non-luminous time of said luminous elements.

3. The self-luminous display device according to claim 2, wherein said external drive circuit further includes a luminance selection section which has a plurality of manual switches and generates a luminance control signal which is a combination of logic values corresponding to the operation of the manual switches, and the switch control signal generator is configured to determine a luminance level based on a dimmer signal supplied from said luminance selection section and set a ratio of a high-level period to a low-level period of the switch control signal according to the luminance level.

4. The self-luminous display device according to claim 2, wherein said switch control signal generator includes a luminance selection section which generates a reference voltage varied by use of a variable resistor, a sawtooth waveform generating circuit which generates a sawtooth voltage, and a comparator which compares the sawtooth voltage generated from said sawtooth waveform generating circuit with the reference voltage to set a ratio of a high-level period to a low-level period of the switch control signal.

5. The self-luminous display device according to claim 2, wherein said switch control signal generator is configured to change a level of a switch control signal in a preset period shorter than the updating period of the video signal, said panel includes a plurality of registers cascade-connected to form a shift register which shifts the switch control signal from said switch control signal generator in the preset period, and said dimmer switch portion includes a plurality of dimmer switches which are respectively connected in series with said driving transistors and said luminous elements between said paired power lines on said panel and each controlled by a switch control signal from a corresponding one of said registers.

6. The self-luminous display device according to claim 2, wherein said dimmer switch portion is a single switch inserted between said paired power lines on said panel and is controlled by a switch control signal from said switch control signal generator.

7. The self-luminous display device according to claim 6, further comprising a photosensitive element which receives light applied to said panel from the exterior and a correction circuit which corrects the switch control signal from said switch control signal generator.

8. The self-luminous display device according to claim 6, wherein said switch control signal generator is configured to determine a luminance level based on a dimmer signal supplied from said exterior and change a ratio of a high-level period to a low-level period of the switch control signal according to the luminance level.

9. The self-luminous display device according to claim 8, wherein said switch control signal generator is configured to correct the luminance level determined based on a dimmer signal according to a signal depending on a service environment of said panel.

10. The self-luminous display device according to claim 2, wherein said dimmer switch portion is a single switch inserted between said paired power lines in said power supply circuit and is controlled by a switch control signal from said switch control signal generator.

11. The self-luminous display device according to claim 1, wherein said dimmer switch portion includes a plurality of dimmer switches which are respectively connected in series with said driving transistors and said luminous elements between said paired power lines on said panel and commonly controlled by a switch control signal.

12. The self-luminous display device according to claim 1, wherein said dimmer switch portion includes a plurality of switch elements which are respectively connected between said driving transistors and said luminous elements on said panel.

13. The self-luminous display device according to claim 1, wherein said dimmer switch portion includes a plurality of switch elements which are respectively connected between said driving transistors and one of said power lines on said panel.

14. The self-luminous display device according to claim 1, wherein said dimmer switch portion includes a plurality of first switch elements which are respectively connected between said driving transistors and said luminous elements on said panel and a plurality of second switch elements which are respectively connected between said driving transistors and one of said power lines on said panel.

15. A driving method of a self-luminous display device including a plurality of luminous elements which form a display screen and are connected between paired power lines in series with driving transistors, each having a gate which is connected to a pixel switch for applying a video signal as a gate voltage and to a capacitor for holding the gate voltage, comprising:

supplying driving signals from said driving transistors to said luminous elements, each of the driving signals corresponding to the gate voltage applied to a corresponding driving transistor; and adjusting luminance of the display screen by switching the driving signals to equally change ratios of luminous time to non-luminous time of said luminous elements, said adjusting including switching at least one dimmer switch, each dimmer switch configured to switch the driving signal of a plurality of said luminous elements.

16. The driving method according to claim 15, wherein adjusting the luminance of said display screen is performed by switching the driving signal at least once in an updating period of a video signal while respectively changing the driving signals of said luminous elements according to the video signal.

17. A self-luminous display device comprising:

a plurality of signal lines;

a plurality of scanning lines disposed to intersect said signal lines approximately at right angles;

a plurality of pixel switches which are disposed near intersections between said signal lines and said scanning lines and each output a video signal on a corresponding one of said signal lines when driven via a corresponding one of said scanning lines;

a plurality of capacitors which are respectively connected to said plurality of pixel switches and each hold a video signal output from a corresponding one of said pixel switches for a preset period of time;

a plurality of display pixels arrayed in a matrix form and each driven based on a video signal from a corresponding one of said pixel switches, and a switch portion which equally controls driving times of said display pixels to adjust a whole luminance level, said signal lines, scanning lines, pixel switches, capacitors and display pixels being provided on an insulating substrate, said switch portion including at least one driving transistor, each driving transistor configured to control the driving time of a plurality of display pixels.

18. The self-luminous display device according to claim 17, wherein each of said display pixels includes a display element having a luminous layer formed between paired electrodes, and a driving transistor which supplies a driving signal to said display element based on the video signal.

19. The self-luminous display device according to claim 18, wherein said display element is an organic EL display pixel in which the luminous layer is formed of an organic EL layer.

20. The self-luminous display device according to claim 18, wherein the display element is configured to emit light in a supply period of the driving signal controlled by said switch portion.

21. The self-luminous display device according to claim 17, wherein said switch portion includes a plurality of driving transistors having the same multi-layered structure as said pixel switches and formed together with said pixel switches on said insulating substrate.

22. The self-luminous display device according to claim 17, further comprising a signal line driver which drives said signal lines and a scanning line driver which drives said scanning lines, wherein said signal line driver and scanning line driver are formed together on said insulating substrate.

23. The self-luminous display device according to claim 17, wherein said switch portion is disposed outside a display region including a matrix of said display pixels on said insulating substrate.

24. The self-luminous display device according to claim 17, wherein said switch portion includes a plurality of driving transistors separately incorporated into said display pixels.

25. The self-luminous display device according to claim 24, wherein said driving transistors are configured to control driving time for each row unit of said display pixels.

26. A self-luminous display device comprising:

a plurality of luminous elements forming a display screen;

a driving signal supply section which supplies driving signals to said luminous elements;

a luminance adjusting section which equally changes the ratios of luminous time to non-luminous time of said luminous elements by switching the driving signals from said driving signal supply section to adjust luminance of the display screen;

an external drive circuit including a power supply circuit which supplies a power-supply voltage to paired power lines and a switch control signal generator which generates a switch control signal used to determine ratios of luminous time to non-luminous time of said luminous elements, wherein said driving signal supply section includes a plurality of element driving sections which respectively change the driving signals of said plurality of luminous elements according to a video signal, said luminance adjusting section includes a dimmer switch portion which switches the driving signal at least once in an updating period of the video signal to adjust the luminance of the display screen, wherein said luminous elements are formed together with said element driving section on a single panel, and each of said element driving sections includes a driving transistor which is connected in series with a corresponding one of said luminous elements between said paired power lines and causes a driving signal corresponding to the gate voltage thereof to flow through the corresponding luminous element, a pixel switch which applies a voltage of the video signal to the driving transistor as the gate voltage thereof, and a capacitor which holds the gate voltage of the driving transistor, and said dimmer switch portion is a single switch inserted between said paired power lines on said panel and is controlled by a switch control signal from said switch control signal generator.

27. The self-luminous display device according to claim 26, wherein said dimmer switch portion is a single switch inserted between said paired power lines in said power supply circuit and is controlled by a switch control signal from said switch control signal generator.

28. The self-luminous display device according to claim 26, wherein said external drive circuit further includes a luminance selection section which has a plurality of manual switches and generates a luminance control signal which is a combination of logic values corresponding to the operation of the manual switches, and the switch control signal generator is configured to determine a luminance level based on a dimmer signal supplied from said luminance selection section and set a ratio of a high-level period to a low-level period of the switch control signal according to the luminance level.

29. The self-luminous display device according to claim 26, wherein said switch control signal generator includes a luminance selection section which generates a reference voltage varied by use of a variable resistor, a sawtooth waveform generating circuit which generates a sawtooth voltage, and a comparator which compares the sawtooth voltage generated from said sawtooth waveform generating circuit with the reference voltage to set a ratio of a high-level period to a low-level period of the switch control signal.

30. The self-luminous display device according to claim 26, wherein said switch control signal generator is configured to change a level of a switch control signal in a preset period shorter than the updating period of the video signal, said panel includes a plurality of registers cascade-connected to form a shift register which shifts the switch control signal from said switch control signal generator in the preset period, and said dimmer switch portion includes a plurality of dimmer switches which are respectively connected in series with said driving transistors and said luminous elements between said paired power lines on said panel and each controlled by a switch control signal from a corresponding one of said registers.

* * * * *